US005571660A

United States Patent [19]

Ito et al.

[11] Patent Number: 5,571,660

[45] Date of Patent: Nov. 5, 1996

[54] METHOD FOR FORMING AN IMAGE

[75] Inventors: Hirohide Ito; Takeo Arai, both of Hino, Japan

[73] Assignee: Konica Corporation, Tokyo, Japan

[21] Appl. No.: 528,799

[22] Filed: Sep. 15, 1995

Related U.S. Application Data

[63] Continuation-in-part of Ser. No. 300,145, Sep. 2, 1994, abandoned.

[30] Foreign Application Priority Data

Sep. 8, 1993 [JP] Japan ..... 5-223558

[51] Int. Cl.[6] ..... G03C 5/18; G03C 5/26

[52] U.S. Cl. ..... 430/399; 430/264; 430/434; 430/592

[58] Field of Search ..... 430/264, 399, 430/434, 592

[56] References Cited

U.S. PATENT DOCUMENTS 5,153,098 10/1992 Takagi ..... 430/264
5,288,595 2/1994 Watanabe et al. ..... 430/393

FOREIGN PATENT DOCUMENTS 0363104 4/1990 European Pat. Off. .
540295 5/1993 European Pat. Off. .
5-134346 5/1993 Japan .
5-224330 9/1993 Japan .

*Primary Examiner*—Geraldine Letscher
*Attorney, Agent, or Firm*—Frishauf, Holtz, Goodman, Langer & Chick, P.C.

[57] ABSTRACT

A method of forming an image is disclosed, comprising imagewise-exposing a silver halide photographic light sensitive material and developing the exposed photographic material to form a high contrast image, wherein said silver halide photographic material contains a spectral sensitizing dye represented by the following formula [S], and wherein said photographic material is developed with a developer having a pH of 10.9 or less, said developer being replenished by a developer-replenishing solution having a pH value of 10.9 or less in an amount of 300 ml or less per $m^2$ of the photographic material. The photographic material further contains a hydrazine compound and a nucleation-accelerating agent.

4 Claims, No Drawings

METHOD FOR FORMING AN IMAGE

This is a Continuation-In-Part, of application Ser. No. 08/300,145, filed Sep. 2, 1994 abandoned.

FIELD OF THE INVENTION

The present invention relates to an image forming method which is stable and free from residual color stains.

BACKGROUND OF THE INVENTION

In recent years, development of a laser light source emitting a light of a red wavelength region has made the use of a silver halide photographic light-sensitive material recorded by the laser source active in the printing or medical fields. Particularly in the printing field a large amount of facsimile films or scanner films are used, and a helium-neon laser having an output wavelength of 632.8, a semiconductor laser having an output wavelength of 650–700 nm and a light emitting diode (LEWD) are used.

However, a dye having a high spectral sensitivity in a red-light wavelength region is difficult to dissolve out on development, and the elimination of the residual color stains is insufficient when rapid processing or a small amount of replenishing is conducted as in recent years. As a result, a serious problem occurs in view of photographic properties or commercial value.

The prior art improving such residual color stains of the light sensitive material is disclosed in U.S. Pat. Nos. 2,493,747 and 2,526,632 incorporating a water solubilizing group to a cyanine dye. Further, there are proposed methods that use a three nuclear merocyanine dye disclosed in Japanese Patent Publication Open to Public Inspection No.2-143242 and a three nuclear merocyanine dye having two water solubilizing groups disclosed in Japanese Patent Publication Open to Public Inspection No.3-171135.

However, when the replenishing amount of a developer replenisher is small as not more than 300 ml/m$^2$ of a light sensitive material and the pH of a developer is not more than 10.9, these sensitizing dyes had problems in that the dyes dissolved out the light sensitive material or decomposition products thereof accumulated in the developer and had an adverse effect on photographic properties, and in that the developer was dyed resulting in dyeing the light sensitive material. Particularly, the problems are remarkable in a hybrid light sensitive material containing a tetrazolium salt likely to be influenced by development conditions, a hydrazine compound or a pyridium salt as a contrast increasing agent. Therefore, a new development technique has been demanded on small amounts of replenishing.

SUMMARY OF THE INVENTION

An objective of the invention is to provide an image forming method which is improved in fog and black spot, furthermore, stable and free from residual color stains in the case of small amounts of replenishing.

The above problems can be solved by an image forming method of processing a silver halide photographic light sensitive material spectrally sensitized by a sensitizing dye represented by the following Formula (S) with a developer having a pH of not more than 10.9, the developer being replenished with a replenisher having a pH of not more than 10.9 in an amount of 300 ml/m$^2$ of the material.

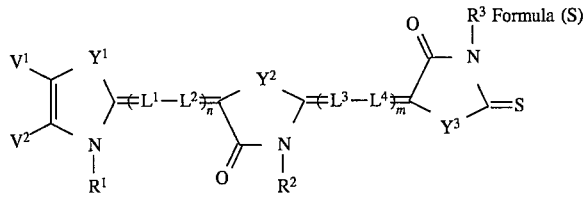

wherein $Y^1$, $Y^2$ and $Y^3$ independently represent an —N(R)— group, an oxygen atom, a sulfur atom or a selenium atom, except that $Y^1$, $Y^2$ and $Y^3$ are each a sulfur or selenium atom; R, $R^1$, $R^2$ and $R^3$ independently represent an aliphatic group, an aryl group or a heterocyclic group, provided that at least one of R, $R^1$, $R^2$ and $R^3$ is substituted with a water-solubilizing group; $V^1$ and $V^2$ independently represent a hydrogen atom, an alkyl group, an alkoxy group or an aryl group, provided that $V^1$ and $V^2$ combine with each other to form a ring; and $L^1$, $L^2$, $L^3$ and $L^4$ independently represent a substituted or unsubstituted methine carbon; n represents 1 or 2; m represents 0 or 1; $M^1$ represents an ion necessary for compensating the total charge of the molecule; and $n^1$ is a number necessary for neutralizing the charge of the molecules.

DETAILED DESCRIPTION OF THE INVENTION

In formula [S] of the present invention, $Y^1$, $Y^2$ and $Y^3$ represent independently —N(R)—, or a oxygen, sulfur or selenium atom, except that $Y^1$, $Y^2$ and $Y^3$ each are a sulfur or selenium atom. $Y^1$ represents preferably a group except a sulfur atom and a selenium atom and more preferably, an oxygen atom. At least one of $Y^2$ and $Y^3$ is preferably a sulfur atom.

In the compound represented by Formula (S) used in the invention, the water-solublilizing group substituted on R, $R^1$, $R^2$ and $R^3$ includes an acid group such as a sulfo group, a carboxy group, a phosphono group, a sulfate group, a sulfino group, a sulfonamido group or a sulfamoyl group and these groups may be in the form of a salt such as an alkali metal salt (lithium, sodium, potassium, calcium), an organic ammonium salt (trimethylammonium or triethanolammonium), or pyridinium salt.

The aliphatic group represented by R, $R^1$, $R^2$ and $R^3$ includes a branched or straight-chained alkyl group having 1 to 10 carbon atoms (for example, a methyl, ethyl, n-propyl, n-pentyl or isobutyl group), an alkenyl group having 3 to 10 carbon atoms (for examole, a 3-butenyl or 2-propenyl group) or an aralkyl group having 3 to 10 carbon atoms (for example, a benzyl or phenetyl group).

The aryl group represented by R, $R^1$, $R^2$ and $R^3$ includes, for example, a phenyl group. The heterocyclic group includes, for example, a pyridyl group (2-, 4-), a furyl group (2-), a thienyl group (2-), a sulfolanyl group, a tetrahydrofuryl group or a piperidinyl group.

Each of the groups represented by R, $R^1$, $R^2$ and $R^3$ may have a substituent, for example, a halogen atom (a fluorine atom, a chlorine atom or a bromine atom), an alkoxy group (a methoxy group or an ethoxy group), an aryloxy group (a phenoxy group or a p-tolyloxy group), a cyano group, a carbamoyl group (a carbamoyl group, an N-methylcarbamoyl group or an N,N-tetramethylenecarbamoyl group), a sulfamoyl group (a sulfamoyl group or an N,N-3-oxapentamethyleneaminosulfonyl group), a methanesulfonyl group, an alkoxycarbonyl group (an ethoxycarbonyl group or a butoxycarbonyl group), an aryl group (a phenyl group or a carboxyphenyl group), or an acyl group (an acetyl group or a benzoyl group).

The typical examples of aliphatic groups substituted with a water-solubilizing group include a carboxymethyl group, a sulfoethyl group, a sulfopropyl group, a sulfobutyl group, a sulfopentyl group, a 3-sulfobutyl group, a 6-sulfo-3-oxahexyl group, a ω-sulfopropoxycarbonylmethyl group, a ω-sulfopropylaminocarbonylmethyl group, a 3-sulfobutyl group, a 3-phosphonopropyl, a 4-sulfo-3-butenyl group, a 2-carboxy-2-propenyl group, an o-sulfobenzyl group, a p-sulfophenethyl group or a p-carboxybenzyl group. The typical examples of aryl groups substituted with a water-solubilizing group include a p-sulfophenyl group or a p-carboxyphenyl group. The typical examples of heterocyclic groups substituted with a water-solubilizing group include a 4-sulfothienyl group or a 5-carboxypyridyl group.

The alkyl group represented by $V^1$ and $V^2$ includes a straight-chained or branched group (such as a methyl, ethyl, iso-propyl, t-butyl, iso-butyl, t-pentyl or hexyl group). The alkoxy group represented by $V^1$ and $V^2$ includes a methoxy group, an ethoxy group, a propoxy group a 2-methoxyethoxy group or a benzyloxy group.

The aryl group represented by $V^1$ and $V^2$ may have a substituent in any position, and the aryl group includes a phenyl group, a tolyl, a p-hydroxyphenyl group or a p-methoxyphenyl group. The condensed ring which $V^1$ and $V^2$ combine each other and form together with an azole ring includes a condensed ring such as benzoxazole, 4,5,6,7-tetrahydrobenzoxazole, naphtho[1,2-d]oxazole, naphtho[2,3-d]oxazole, benzothiazole, 4,5,6,7-tetrahydrobenzothiazole, naphtho[1,2-d]thiazole, naphtho[2,3-d]thiazole, benzoselenazole or naphtho[1,2-d]selenazole.

In the above-mentioned substituent represented by $V^1$ or $V^2$ and the condensed ring formed, there may be a substituent in any position. The substituent includes a halogen atom (a fluorine atom, a chlorine atom, a bromine atom or a iodine atom), a trifluoromethyl group, an alkoxy group (an unsubstituted alkyl group, e.g., a methoxy, ethoxy or butoxy group, or a substituted alkoxy group, e.g., a 2-methoxyethoxy or benzyloxy group), an alkylthio group (a substituted or unsubstituted alkyl group such as a methylthio or ethoxyethylthio group), a hydroxy group, a cyano group, an aryloxy group (a substituted or unsubstituted group, e.g., a phenoxy or tolyloxy group), or an aryl group (a substituted or unsubstituted group, e.g., a phenyl and p-chlorophenyl group), a styryl group, a heterocyclic group (a furyl or thienyl group), a carbamoyl group (a carbamoyl or N-ethylcarbamoyl group), a sulfamoyl group (a sulfamoyl and N,N-dimethylsulfamoyl group), an acylamino group (an acetylamino, propionylamino or benzoylamino group), an acyl group (an acetyl or benzoyl group), an alkoxycarbonyl group (an ethoxycarbonyl group), a sulfonamido group (a methanesulfonylamido or benzenesulfonamido group), a sulfonyl group (a methanesulfonyl and p-toluenesulfonyl group) or a carboxy group.

A methine group represented by $L^1$, $L^2$ $L^3$ and $L^4$ may be substituted by a lower alkyl group having 1 to 5 carbon atoms (a methyl or ethyl group), a phenyl group (a phenyl or carboxyphenyl group) or an alkoxy group (a methoxy or ethoxy group). n represents 1 or 2, and m represents 0 or 1. $M^1$ represents a cation or an acid anion. The typical example of the cation includes proton, an organic ammonium ion (a triethyl ammonium or triethanol ammonium group) or an inorganic cation (a cation of lithium, sodium or calcium). The typical example of the acid anion includes a halogen ion (an ion of chloride, bromide or iodide), a p-toluene sulfonic acid ion, a perchloric acid ion or a borontetrafluoride ion. When an intramolecular salt is formed to neutralize a charge, $n^1$ becomes 0.

In the above Formula (S), it is preferable that $R^1$ represents an alkyl group having a sulfo group and at least two of R, $R^2$ and $R^3$ represent carboxy groups.

The typical example of a sensitizing dye represented by Formula (S) will be given below.

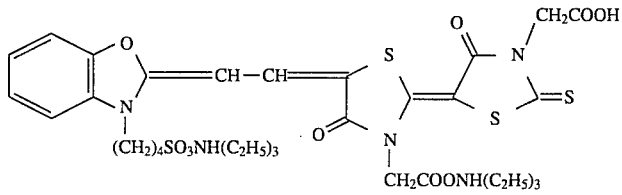

S-1

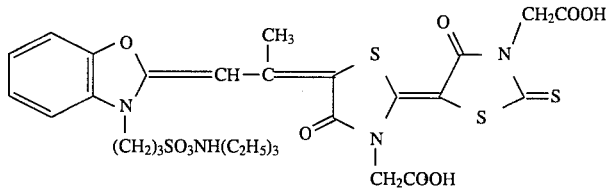

S-2

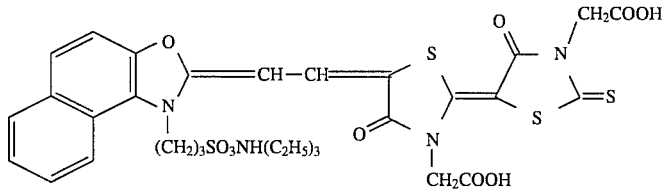

S-3

-continued
S-4
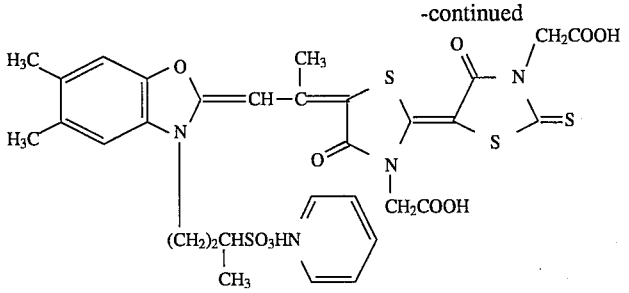
S-5
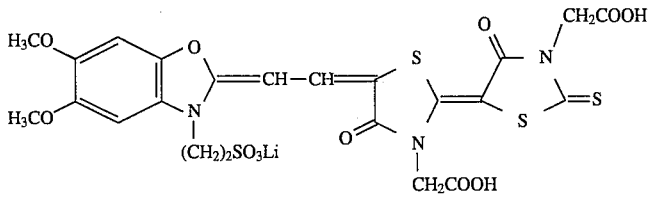
S-6
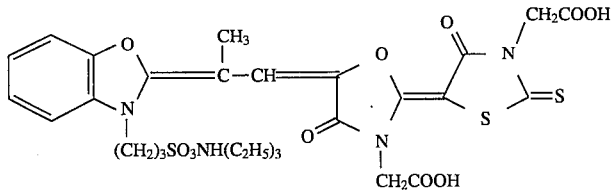
S-7
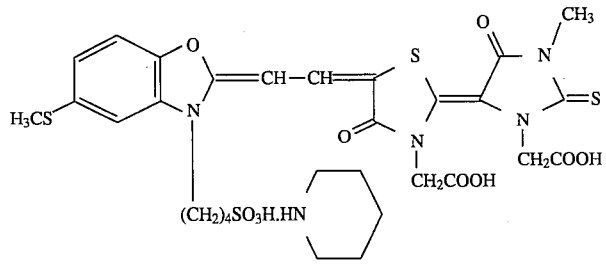
S-8
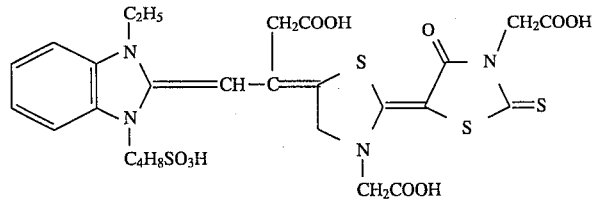
S-9
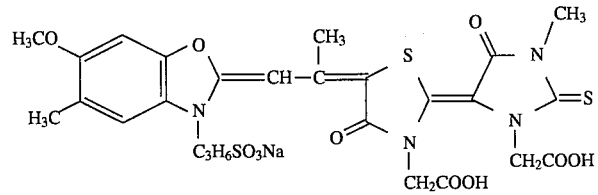
S-10
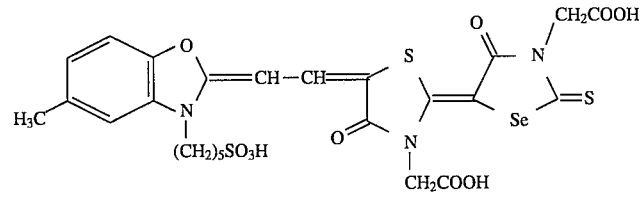

-continued
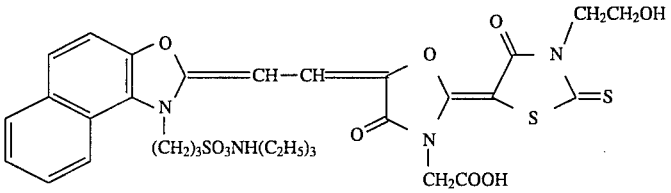
S-11
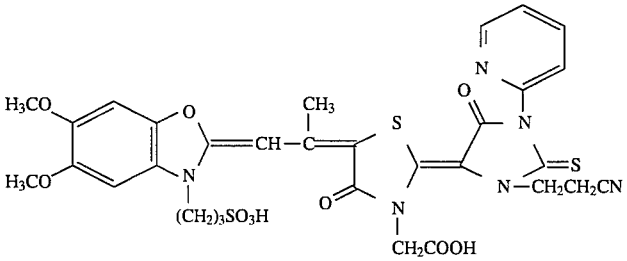
S-12
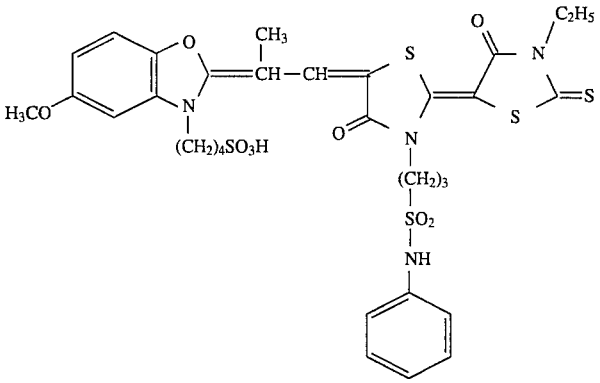
S-13
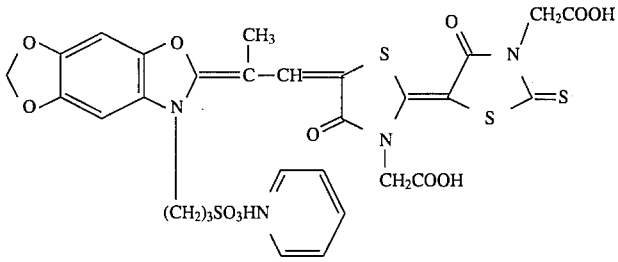
S-14
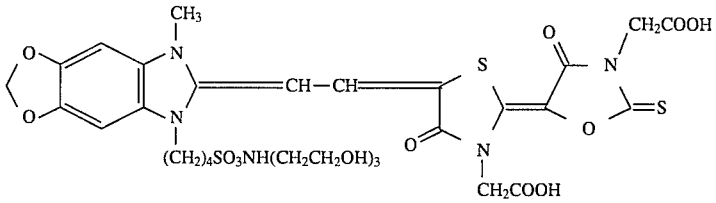
S-15
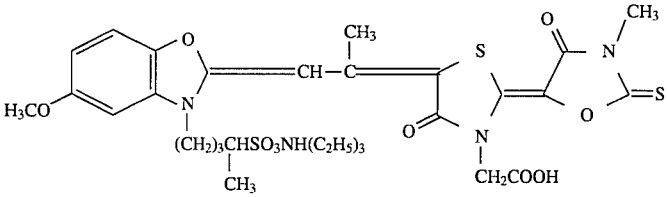
S-16

-continued

S-17

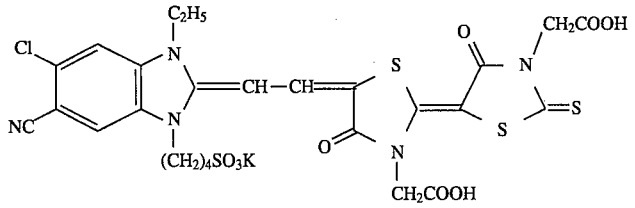

S-18

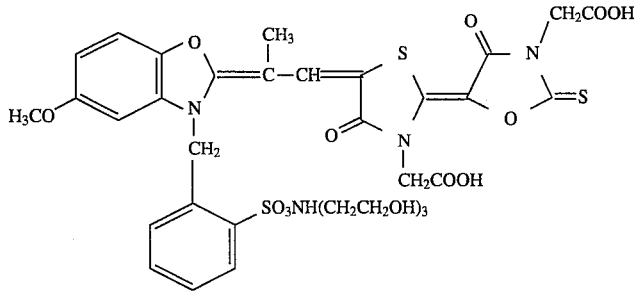

S-19

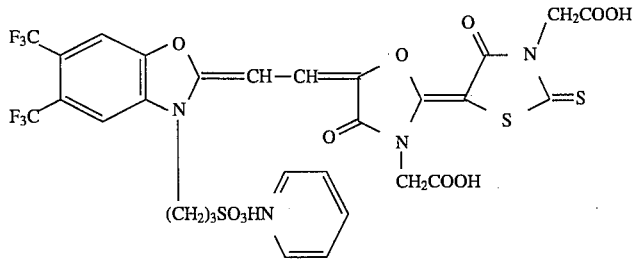

S-20

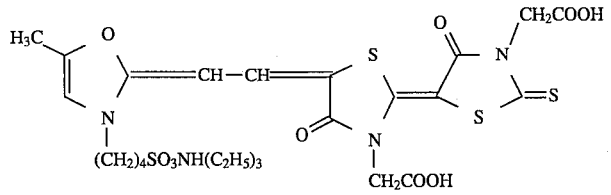

S-21

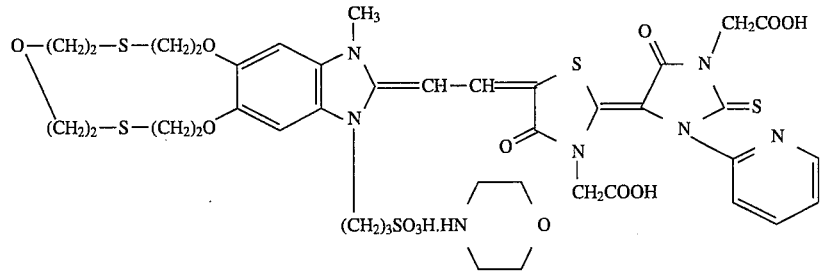

Next, as a contrast-increasing agent used in the present invention, a hydrazine derivative, pyridinium salt, or tetrazolium salt is employed singly or in combination thereof. Hydrazine compound represented by the following formula [H] is preferably used.

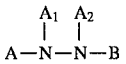

Formula [H]

Formula [H] is explained in detail as below.

A replesants an aliphatic, aryl or heterocyclic group. In the formula, the aliphatic group represented by A preferably has 1–30 carbon atoms. Especially, it is a straight-chain, branched or cyclic alkyl group which has 1–20 carbons, such as methyl group, ethyl group, t-butyl group, octyl group, cyclohexyl group, and benzyl group. These groups may further be substituted by a suitable substituent, for example, an aryl group, alkoxy group, aryloxy group, alkyl thio group, aryl thio group, sulfoxy group, sulfonamide group, acylamino group, or ureido group.

The aryl group represented by A in Formula [H] is preferably a single condensed ring of an aryl group. For example, benzene ring and naphthalene ring can be mentioned.

In formula [H], the heterocyclic group represented by A is preferably a single or condensed ring containing one hetero atom selected from nitrogen, sulfur, and oxygen. For example, pyrrolidine ring, imidazole ring, tetrahydrofuran ring, morpholine ring, pyridine ring, pyrimidine ring, quinoline ring, thiazole ring, benz-thiazole ring, thiophene ring, and furan ring can be mentioned.

As A, an aryl group and a heterocyclic group are especially preferable.

The aryl group or the heterocyclic group represented by A may have a substituent. As typical substituents, an alkyl group, preferably, one having 1–20 carbon atoms, an aralkyl group, preferably, of single or fused ring of which alkyl part contains one to three carbon atoms, an alkoxy group, preferably, one having 1–20 carbon atoms in a alkyl part, a substituted amino group, preferably, amino group substituted by an alkyl or alkylidene group having 1–20 carbon atoms, an acylamino group, preferably, the one having 1–40 carbon atoms, a sulfonamide group, preferably, the one having 1–40 carbon atoms, an ureide group, preferably, the one having 1–40 carbon atoms, a hydrazinocarbonylamino group, preferably, the one having 1–40 carbon atoms, a hydroxyl group and a phosphonoamide group, preferably, the one having 1–40 carbon atoms can be mentioned.

Moreover, it is preferable for A to contain a diffusion inhibiting group or an adsorption promoting group on the silver halide. As for the diffusion inhibiting group, so-called a ballast group, which is usually used in non-diffusible photographic additives such as a coupler. As examples of the ballast group, a photographically inactive organic group, such as alkyl group, alkenyl group, alkinyl group, alkoxy group, phenyl group, phenoxy group, or alkyl phenoxy group containing eight or more carbon atoms can be mentioned.

Examples of the adsorption promoting group on the silver halide grain, for example, include thiourea, a thio urethane group, a mercapto group, a thio ether group, a thione group, a heterocyclic group, a thio amide heterocyclic group, a mercapto heterocyclic group, or groups disclosed in Japanese Patent O.P.I. Publication No. 64-90439/1989.

B is a univalent blocking group. More precisely, B is an univalent group represented by —G—$R^6$.

In —G—$R^6$, G represents a carbonyl group, a sulfonyl group, a sulfoxy group, a phosphonyl group or an iminomethylene group. G is preferably a carbonyl group.

In the above, $R^6$ is a hydrogen atom or a blocking group such as an aliphatic group such as mthyl, ethyl, benzyl, methoxymethyl, trifluoromethyl, phenoxymethyl, 4-methoxybenzenesulfonylmethyl, 1-pyridiniomethyl, hydroxymethyl, methylthiomethyl, or phenylthiomethyl; an aromatic group such as phenyl, hydroxymethylphenyl, or chlorophenyl; a heterocyclic group such as pyridyl, thienyl, furyl, or N-methylpyridinio; an amino group such as methylamino, dimethylamino, or phenylamino; an alkoxy group such as methoxy, ethoxy, or butoxy; an aryloxy group such as phenoxy; a group represented by —$COOR_8$ and a group represented by —$CON(R_9)(R_{10})$, wherein $R_8$ is a hydrogen atom, an alkyl groups such as methyl, ethyl, benzyl, or hydroxyethyl; an alkenyl group such as allyl, or butenyl; an alkinyl group such as propalgyl, or butinyl; an aryl group such as phenyl, or naphthyl; and a heterocyclic group, for example, a saturated heterocyclic group such as 2,2,6,6-tetramethylpyperidinyl, N-ethylpyperidinyl, tetrahydrofuryl, or sulfolane and an unsaturated heterocyclic group such as pyridyl, pyrimidyle, thienyl, or furyl; and $R^9$ and $R^{10}$ independently represent a hydrogen atom, an alkyl group such as methyl, ethyl, benzyl, or hydroxyethyl; an alkenyl group such as allyl, or butenyl; an alkinyl group such as propalgyl, or butinyl; an aryl group such as phenyl, or naphthyl; a heterocyclic group, for example, a saturated heterocyclic group such as 2,2,6,6-tetramethylpyperidinyl, N,N'-diethylpyrazolinyl, quinuclidinyl, N-ethylpyperidinyl, N-benzylpyperidinyl, N-benzylpyrolidinyl, tetrahydrofuryl, or sulfolane; an unsaturated heterocyclic group such as pyridyl, pyrimidinyl, thienyl, or furyl; a hydroxyl group, an alkoxy group such as methoxy, ethoxy, benzyloxy, or cyanomethoxy; an alkenyloxy group such as allyloxy, or butenyloxy; an alkinyloxy group such as propalgyloxy, or butinyloxy; an aryloxy group such as phenoxy, or naphthoxy; a heterocyclicoxy group such as pyridyloxy, or pyrimidyloxy; an amino group such as amino, methylamino, dimethylamino, dibenzylamino, or phenylamino.

$R^6$ is preferably a hydrogen atom, an aliphatic group, an aromatic group, and groups represented by —$COOR_8$ and —$CON(R_9)$ $(R_{10})$. And —$COOR_8$ and —$CON(R_9)$ $(R_{10})$ groups are most preferable.

The most preferable $R_6$ is a $COOR_8$ group or $CON(R_9')$ $(R_{10}')$, wherein $R'_8$ represents an alkinyl group or a saturated heterocyclic group; $R'_9$ represents a hydrogen atom, an alkyl group, an alkenyl group, an alkinyl group, an aryl group or a heterocyclic group; and $R'_{10}$ represents an alkenyl group, an alkinyl group, a saturated heterocyclic group, a hydroxyl group or an alkoxy group.

$A_1$ and $A_2$ both represent hydrogen atoms, or one of them represents a hydrogen atom while the other is an acyl group such as acetyl, trifluoroacetyl, or benzoyl; a sulfonyl group such as methanesulfonyl, toluenesulfonyl or an oxalyl group such as ethoxyoxalyl.

Among hydrazine compounds used in the present invention, preferable one is represented by formula [Ha] as below:

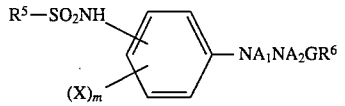

Formula [Ha]

wherein $R^5$ represents an aliphatic group or an aromatic group. The aliphatic group is preferably one having 1 to 30 carbon atoms, and particularly preferably a straight chain, branched or cyclic alkyl group having 1 to 20 carbon atoms. The cyclic alkyl group may be cyclized so as to form a saturated heterocyclic ring containing one or more heteroatoms such as nitrogen, oxygen, sulfur or selenium. As examples of the alkyl group are cited methyl, ethyl, t-butyl, octyl, decyl, cyclohexyl or benzyl. Also, the alkyl group may be substituted with substituent(s) such as an aryl group, alkoxy group aryloxy group, arylthio group, sulfoxy group, sulfoamide group and carboamide group.

The aromatic group is preferably a monocyclic or bicyclic aryl group, or an unsaturated heterocyclic group. As examples thereof are cited benzene rings such as phenyl, 2-hydroxyphenyl or chlorophenyl, naphthalene rings, pyridine rings, pyrimidine rings, imidazole rings, pyrazole rings, quinoline rings, isoquinoline rings, benzimidazole rings, thiazole rings and benzothiazole rings. Aryl groups are more preferable. These groups may further be substituted by a suitable substituent. X represents a group capable of substituting and m represents an integer of 0–4. When m is two or more, x may be either the same or different. $A_1$, $A_2$ and —G—$R^6$ are the same as defined in formula [H] aforementioned. It is preferable that $R^5$ contains at least one ballast group or a group for acceleration adsorption on silver halide. As the ballast group, one which is usually used in a non-diffusible photographic additives such as coupler is preferable. As for the ballast group, a photographically inactive organic group, such as an alkyl group, an alkenyl group, an alkinyl group, an alkoxy group, a phenyl group, a phenoxy group, or an alkyl-phenoxy group containing eight or more carbon atoms can be mentioned. Also, one which contains repetition structure of alkyleneoxy unit disclosed in Japanese Patent O.P.I. Publication 5-61143/1993 or structure containing quaternary ammonium salt may can be used.

As a group for accelerating adsorption on silver halide, for example, thiourea, a thio urethane group, a mercapto group, a thioether group, a thione group, a heterocyclic group, a thio amide heterocyclic group, a mercapto heterocyclic group, or adsorption groups disclosed in Japanese Patent O.P.I. Publication No. 64-90439/1989 is cited.

A group represented by X in formula [Ha] includes straight chain, branched or cyclic alkyl group, preferably having 1–20 carbon atoms, alkenyl group or alkinyl group, preferably having 2–20 carbon atoms; aryl group such as phenyl; an alkoxy group such as one having 1–20 carbon atoms in the alkyl portion thereof, or one having alkyleneoxy repeating unit, alkenyloxy group such as allyloxy, butenyloxy; an alkinyloxy group such as propagyloxy or butinyloxy; aryloxy group such as phenoxy; acyloxy group such as acetyloxy, propionyloxy or benzoyloxy; an acylamino group such as acetylamino, propionylamino, butanoylamino, octanoylamino or benzoytamino; a sulfonamide group such as methanesulfonamide, ethanesulfonamide, propanesulfonamide, butanesulfonamide, hexanesulfonamide, octanesulfonamide, dodecanesulfonamide or benzenesulfonamide; a ureido group such as methylureido, ethylureido, propylureido, butylureido or hexylureido group, cyclohexylureido, octylureido, dodecylureido, octadecylureido, phenylureido or naphthylureido group; a hydrazinocarbonylamino group such as methylhydrazinocarbonylamino, ethylhydrazinocarbonylamino, dimethylhydrazinocarbonylamino, diphenylhydrazinocarbonylamino or phenylhydrazinocarbonylamino; an alkylamino group such as methylamino, ethylamino, butylamino, octylamino or dodecylamino; a dialkylamino group such as dimethylamino, diethyl amino, dibutylamino or methyloctylamino; an amino group, a hydroxy group; a halogen atom; an alkylthio group, preferably, having 1–20 carbon atoms; an alkenylthio group such as allylthio or butenylthio; a mercapto group, sulfo group; a carboxyl group; a thioureido group such as methylthioureide, ethylthioureide, butylthioureide, cyclohexylthioureide, octylthioureido, dodecylthioureido or phenyl-thioureido; a cyano group; a sulfonyl group such as methanesulfonyl; a sulfamoyl group such as methylsulfamoyl, ethylsulfamoyl, butylsulfamoyl or phenylsulfamoyl; a carbamoyl group such as methylcarbamoyl, ethylcarbamoyl, butylcarbamoyl, octylcarbamoyl or phenylcarbamoyl. These groups can further be substituted by a suitable substituent.

Specific examples of the compounds represented by formulae [H] and [Ha] are given below: However, the scope of the the present invention is not limited by these.

H-1

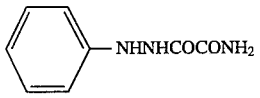

H-2

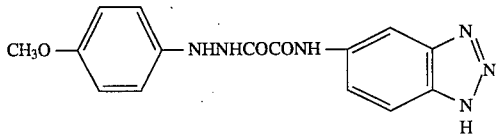

H-3

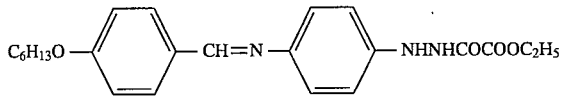

H-4

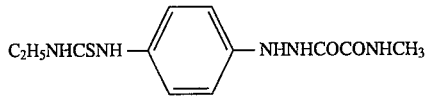

H-5

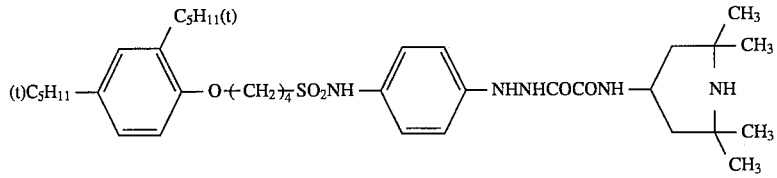

H-6

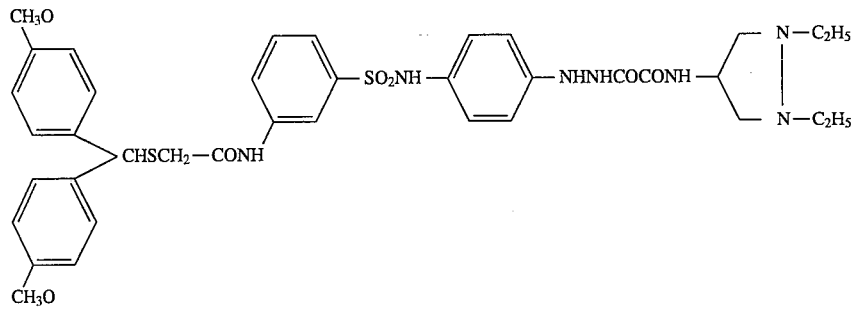

-continued
H-7
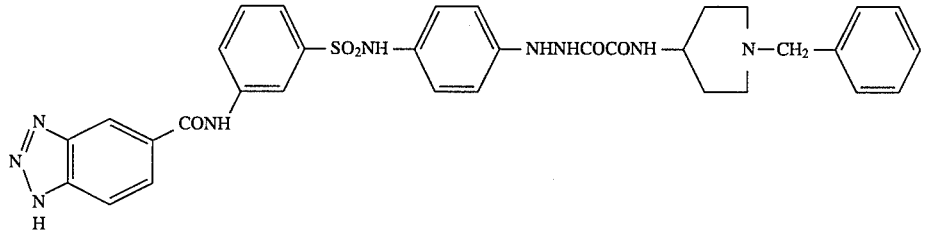
H-8
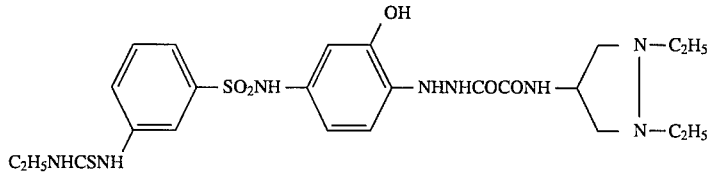
H-9
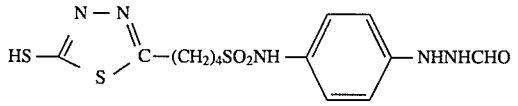
H-10
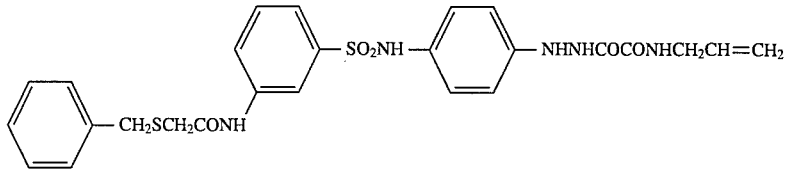
H-11
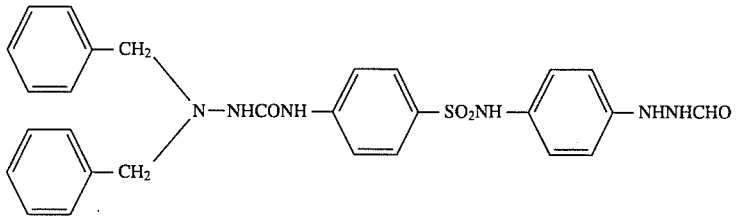
H-12
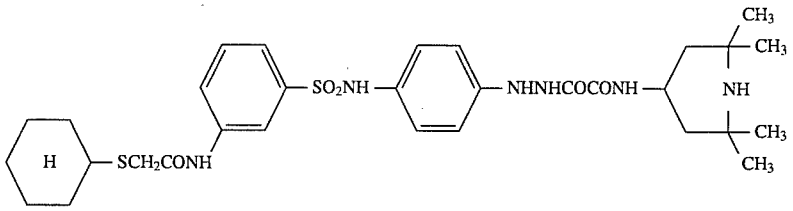
H-13
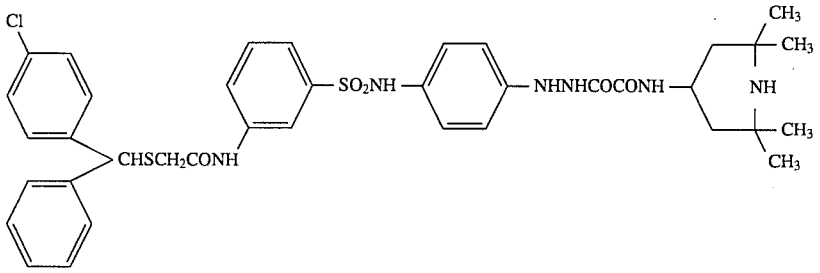
H-14
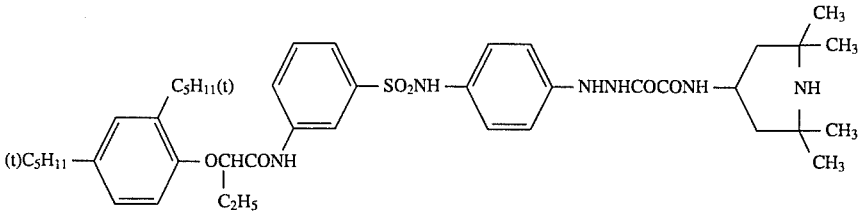

-continued
H-15
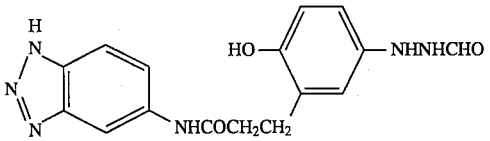
H-16
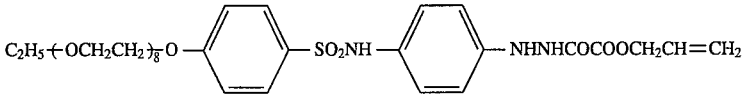
H-17
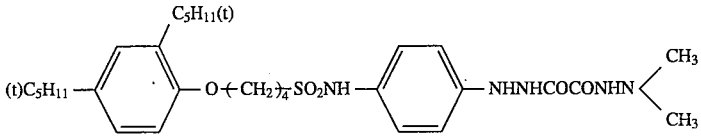
H-18
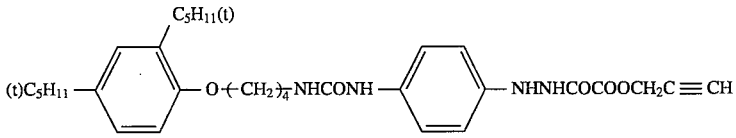
H-19
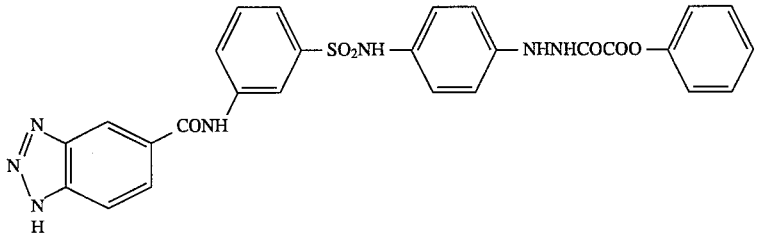
H-20
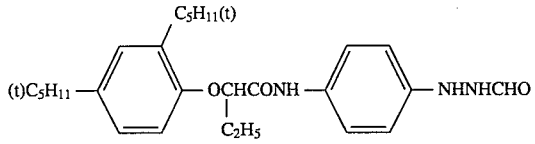
H-21
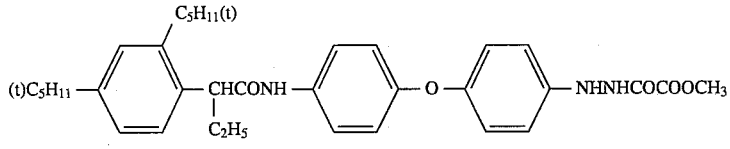
H-22
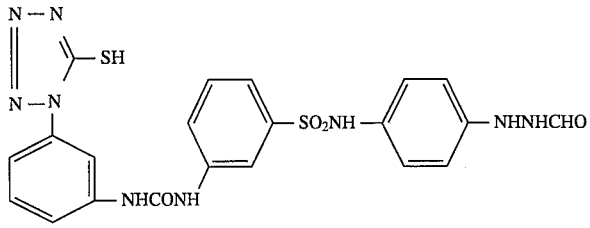
H-23
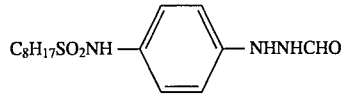
H-24
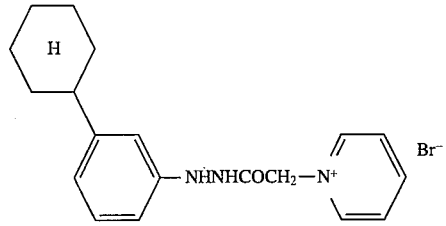

-continued
H-25
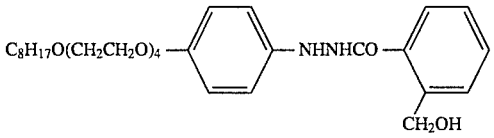
H-26
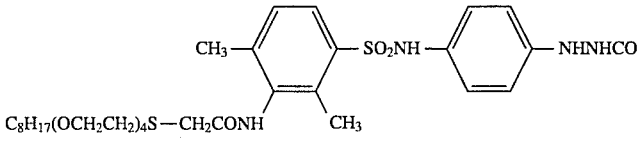
H-27
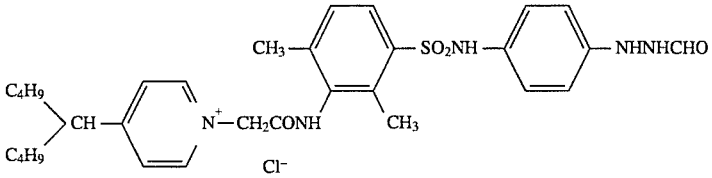
H-28
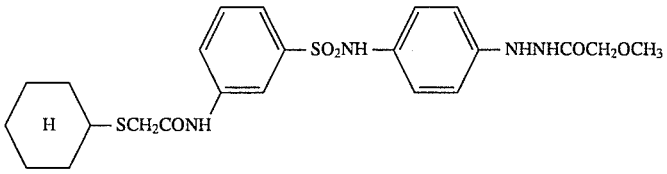
H-29
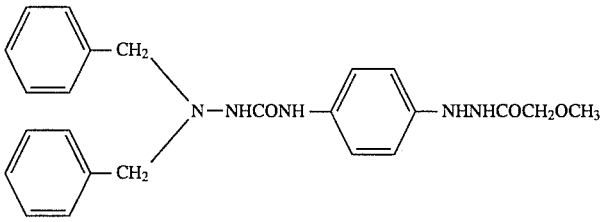
H-30
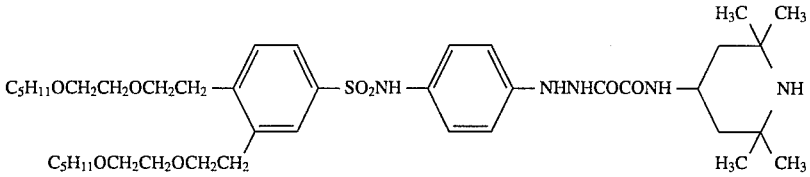
H-31
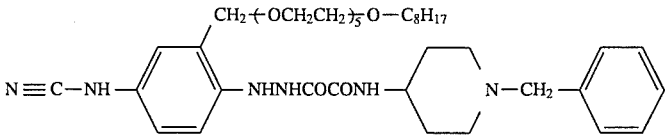
H-32
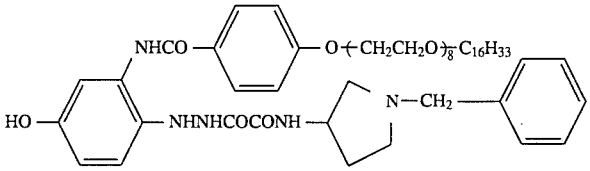
H-33
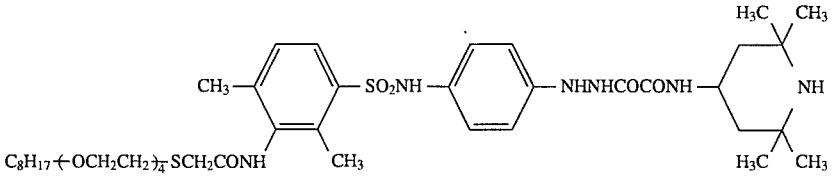

-continued
H-34
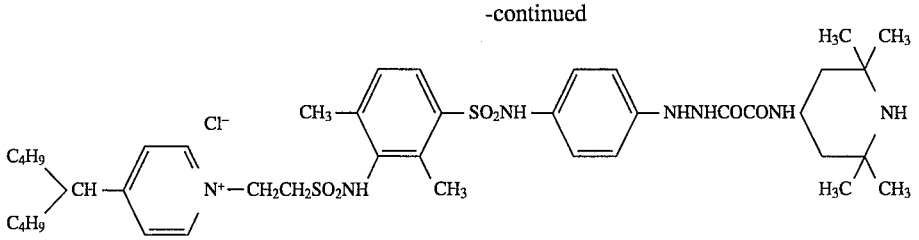
H-35
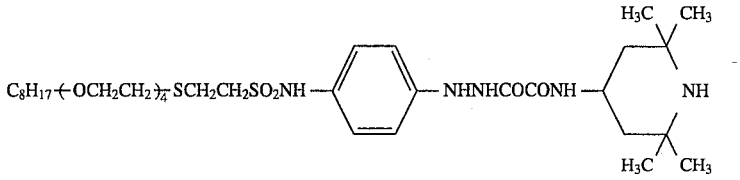
H-36
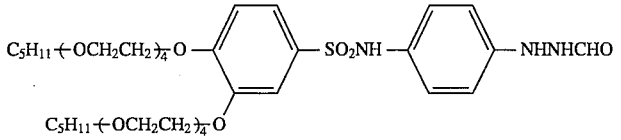
H-37
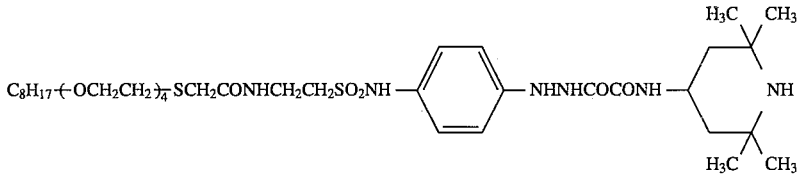
H-38
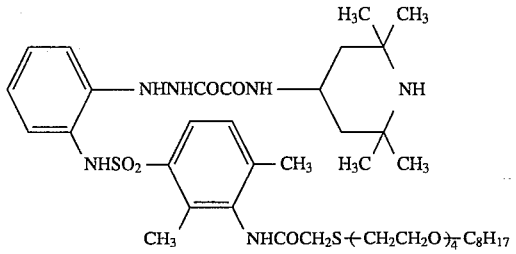
H-39
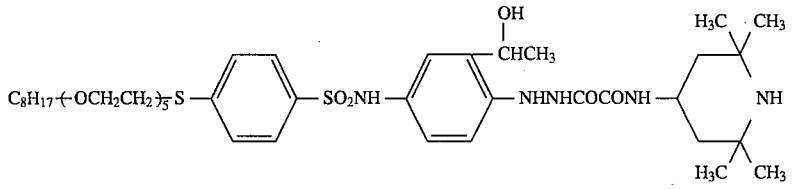
H-40
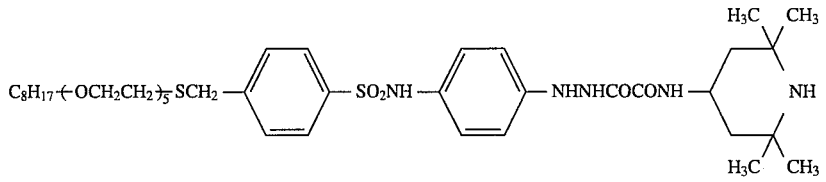
H-41
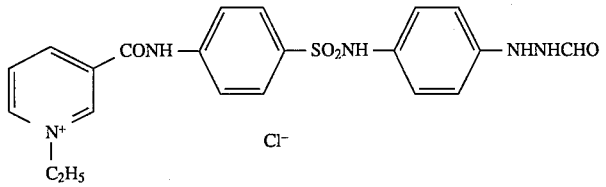

-continued

H-42

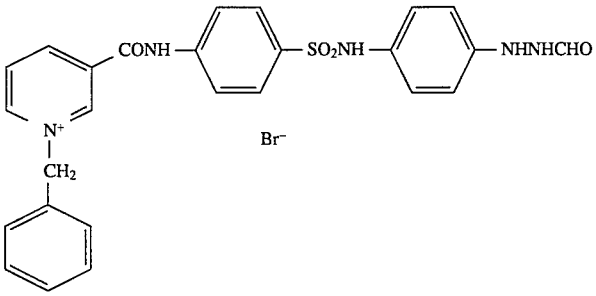

When the hydrazine derivative is incorporated in the light-sensitive photographic material of the present invention, it is usually addeds to a silver halide emulsion lay or a hydrophilic colloidal layer which is adjacent to the silver halide emulsion layer.

In order to promote nucleation reaction by the hydrazine derivative effectively, it is preferable to use a nucleation accelerating agent represented by the following formula [Na] or [Nb].

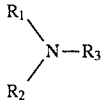

Formula [Na]

In formula [Na], $R_1$, $R_2$, and $R_3$ independently represent a hydrogen atom, an alkyl group, a substituted alkyl group, an alkenyl group, a substituted alkenyl group, an alkinyl group, an aryl group, and a substituted aryl group, provided that a ring can be formed by combining at least two of $R_1$, $R_2$, and $R_3$ with each other.

Among the compounds represented by [Na] is preferably a tertiary Amine compound, which, more preferably, contains a diffusion-proof group or a group for promoting adsorption on silver halide group.

In order for the compound to be diffusion-proof, the compound preferably have a molecular weight of not less than 100 and, more preferably, not less than 300.

A preferable adsorption promoting group is, for example, a heterocyclic ring group, mercapto group, thio ether group, chione group or thiourea group.

A more preferable type among the compounds represented by formula [Na] is a compound represented by the formula [Na2].

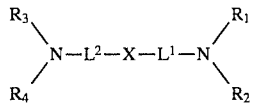

Formula [Na2]

In formula [Na2], $R_1$, $R_2$, $R_3$ and $R_4$ independently represent a hydrogen atom an alkyl group, a substituted alkyl group, an alkenyl group, a substituted alkenyl group, an alkinyl group, a substituted alkinyl group, an aryl group, a substituted aryl group and a saturated or unsaturated heterocyclic group, provided that they can form a ring by combining with each other, and that combinations of $R^1$ and $R^2$, and $R^3$ and $R^4$ are not hydrogen atoms at the same time.

X represents a sulfur atom, selenium atom or tellurium atom. $L_1$ and $L_2$ independently represent a divalent linkage group. Specifically, the divalent group is selected from the group consisting of the following groups or those sabstituted with a group such as a alkylene group, an alkenylene group, an arylene group, an acylamino group, a sulfonamido group: $—CH_2—$, —CH=CH—, pyridine-di-yl, $—N(Z_1)—$ group, —O—, —S—, —(CO)—, $—(SO_2)—$, $—CH_2N—$, wherein $Z_1$ represents a hydrogen atom, an alkyl group, an aryl group.

Further, it is preferable tha the linkage group comprises at least one of the following structures: $—(CH_2CH_2O)—$, $—(C(CH_3)HCH_2O)—$, $—(OC(CH_3)HCH_2O)—$ and $—(OCH_2C(OH)HCH_2)—$.

Specific examples of the nucleation accelerating compounds represented by [Na] are shown below:

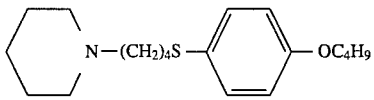

Na-1

$[(C_3H_7)_2N(CH_2)_3OCH_2CH_2]_2S$

Na-2

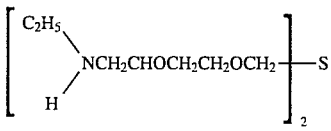

Na-3

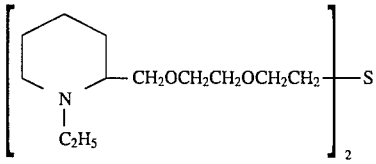

Na-4

-continued
Na-5
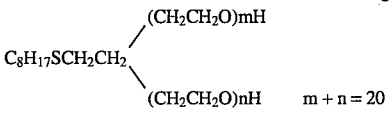
$C_8H_{17}SCH_2CH_2(CH_2CH_2O)mH$, $(CH_2CH_2O)nH$ $m+n=20$
Na-6
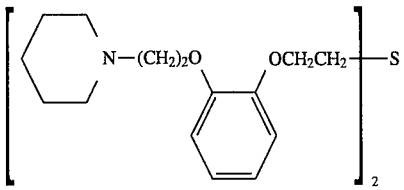
Na-7
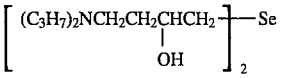
Na-8
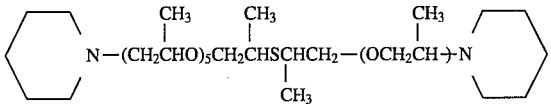
Na-9
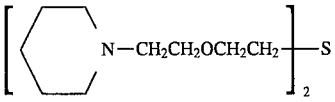
Na-10
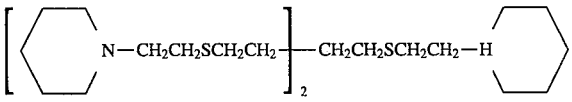
Na-11
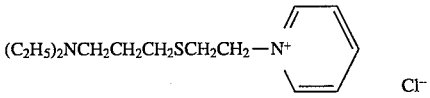
Na-12
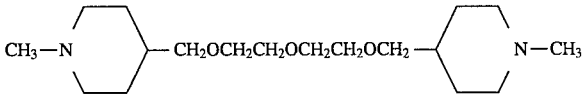
Na-13
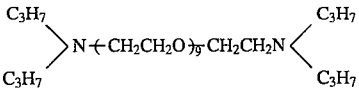
Na-14
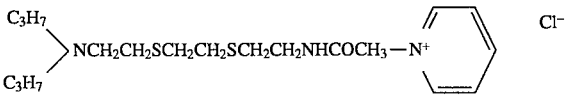
Na-15
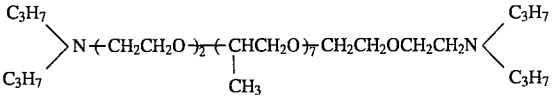
Na-16
$[(C_2H_5)_2N(CH_2)_3NHCOCH_2]_2Se$
Na-17
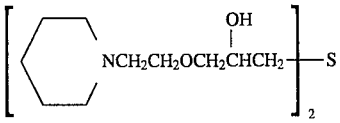
Na-18
$(C_2H_5)_2NCH_2CH_2(OCH(CH_3)CH_2)_7SCH_2CH_2N(C_2H_5)_2$
Na-19
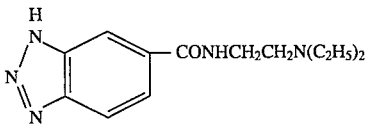

-continued

Na-20

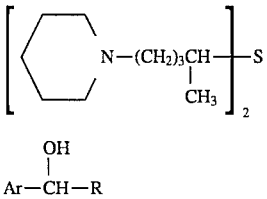

Formula [Nb]

In the formula, Ar represents a substituted or unsubstituted aryl or heterocyclic group. R is a hydrogen atom, an alkyl group, an alkenyl group, an alkinyl group or an aryl group, which may be substituted. Ar and R may combine with each other to form a ring. These compounds each preferably contain a ballast group or a adsorption group onto silver halide A preferable ballast group has a molecular weight of not less than 120, more preferably, not less than 300. The adsorption group is preferably the same as one defined in formula [H].

Specific examples of the compound represented by formula [Hb] are as follows:

Nb-1

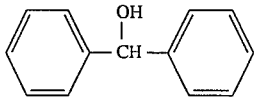

Nb-2

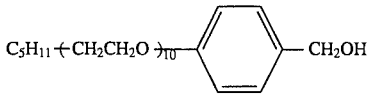

Nb-3

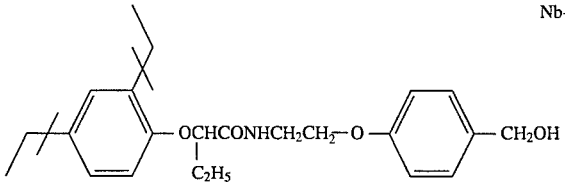

Nb-4

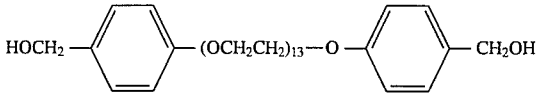

Nb-5

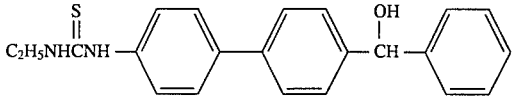

Nb-6

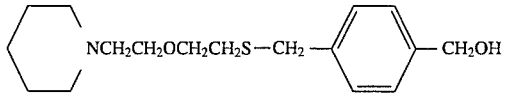

Nb-7

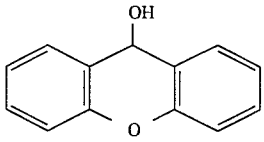

Nb-8

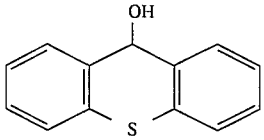

-continued

Nb-9

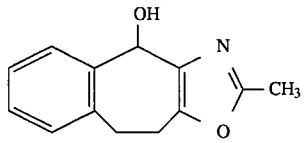

Nb-10

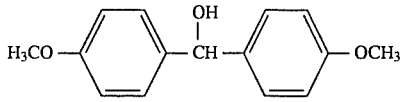

Nb-11

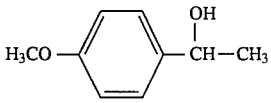

Nb-12

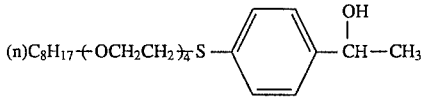

Further, as an image-hardening agent, a tetrazolium compounds and a pyridinium compound may preferably be used, as disclosed Japanese Patent Application Nos. 6-33827/1994, 5-217657/1993, 6-161009/1994, 5-53231/1993, 2-2543/1990 and 1-287557/1989.

In the present invention, a nucleation-accelerating agent may be contained in a silver halide emulsion layer or a hydrophilic colloidal layer adjascent thereto.

Although there is no specific limitation concerning the composition of the silver haide used in the silver halide emulsion layer, silver chloride or silver chlorobromide containing silver bromide is preferable.

Average grain size of the silver halide is preferably not more than 0.7 microns, and more preferably, between 0.1 and 0.5 microns. Herein the term "average grain size" is a terminology commonly used among photographic scientist and engineers and will be easily understood.

Grain size is defined as a diameter of a sphere when the grain can be approximated to have has a spherical shape or a shape.

When the grain is a cubic shape, the grain size (d) is given in terms of the following equation:

$$\text{edge length} \times \sqrt{\frac{4}{\pi}}$$

The average diameter is obtained from algebraic average or from geometric average based on the average projection area of the grain.

For detailed method of obtaining the average grain diameter, "The Theory of the Photographic process" edited by C. E. Mees & T. H. James, 3rd edition, pp 36 through 43, published in 1966 by Mcmillan Ltd. can be referred.

There is no specific limitation with respect to the shape of the silver halide grain, and it may be anyone of tabular, spheric, cubic, tetradecahedral, octahedral or any other shape. And as regards grain size distribution, the narrower is the distribution, the more preferable.

Especially, a so-called mono-dispersion emulsion, in which at least 90%, and, morepreferably more than 95% by number of the total silver halide grains are within 40% by size around the the average grain diameter, is preferable.

As for the manner of reacting aqueous silver salt with aqeous halide salt in the present invention, any conventionally known method, including the single mixing process, the simultaneous mixing process and any combination thereof can be employed.

It is also possible to employ a method, in which formation of the silver halide grain is carried out in excess amount of silver ion, which is so-called a reverse mixing process. As one mode of the simultaneous mixing process, a method in which pAg in the liquid phase where silver halide grain is formed is controlled at a constant level, socalled "controlled double-jet process", may also be used; and by this method a silver halide emulsion containing silverhalide grains with regular shape and narrow grain size distribution can be obtained.

The silver halide grain used in the silver halide emulsion is preferably incorporated during at least one step of nuclear formation or growth thereof with a cadmium salt, zinc salt, lead salt thallium salt, iridium salt, rhodium salt or any other complex salt containing these elements.

As regards these silver halide emulsions and the method for the preparation thereof, Research Disclosure Vol. 176, No. 17643, pages 22 and 23, (December 1973) can be referred.

Silver halide emulsion used in the present invention may or may not be subjected to chemical sensitization. As for the manner of chemical sensitization, sulfur sensitization, reduction sensitization and noble metal sensitization are well known. These are each used either singly or in combination. As for sulfric sensitizing agent besides various sulfur compounds contained in gelatin, various sulfur compounds such as thiosulfides, thioureas, rhodanine comounds polysulfide compounds, etc. can be used.

Among well-known noble metal sensitization processes, gold sensitization is a representative process, and gold compound, mainly gold complex salt is usually used. Besides gold compounds, other noble metal compounds, for example, complex salts of platinum, palladium or rhodium may also be incorporated.

As a reduction sensitizing agent, tin (II) salts, aminecompounds, formaminedisulfinate, silane compounds, etc. can be used.

In the light-sensitive material used in the present invention, various photographic additives can be incorporated for the purposes of, for example, preventing fog from taking place during manufacture, storage or processing thereof,or stabilizing photographic properties.

Such photographic additives include, for example, azole compounds such as benzthiazolium compounds, nitroindazole compounds, nitrobenzimidazole compounds, chlorobenzimidazole compounds, bromobenzimidazole compounds, mercaptothiazole compounds, mercaptobenzothiazole compouds, mercaptobenzimidazole compouds, mercaptobenzothiadiazole compounds, aminotriazole compounds, benztriazole compounds, nitrobenzotriazole compounds, mercaptotetrazole compounds such as 1-phenyl-5-mercaptotetrazole, mercaptopyrimidine compounds, mercaptotriazinecompounds such as oxazolinethione, azaindene compounds such as 4-hydroxy substituted 1,3,3a,7-tetrazaindene compounds, pentazaindene compounds benzenesulfonates, benzenesulfinates, benzenesulfonatezmides and various other compounds which are known as anti-foggants or stabilizers.

The silver halide light-sensitive photographic layer and other non-light-sensitive hydrophilic coloidal layers may contain an inorganic or organic hardener. For example chromium salts such as chromium alum, or chromium acetate, aldehyde compounds such as formaldehyde, glyoxale, or glutaric aldehyde, N-methylole compounds such as dimethylolurea, methyloldimethylhydantin, dioxane derivatives such as 2,3-dihydroxydioxane, active vinyl compounds such as 1,3,5-triacriloyl-hexahydro-s-triazine, bis(vinylsulfonyl)methylether, or N,N'-methylenebis-(β(vinylsulfonyl) propionamide), active halide compounds such as 2.4-dichloro-6-hydroxy-s-triazine, mocohalide compounds such as mocochloric acid, or phenoxymucochloric acid, isoxazole compounds, dialdehyde starch, and 2-chloro-6-hydroxytriazinylated gelatin, etc. can be used either singly or in combination.

Further in the silver halide light-sensitive photographic layer and/or other non-light-sensitive hydrophilic coloidal layers of the present invention, various other photographic additives such as coating aids, anti-static agents, lubricants, emulsification dispersion aids, adhesive agents and other photographic property-improving agents may also be used in accordance with various purposes.

As for a binder or protective colloid for the photographic emulsion, use of gelatin is usually advantageous, however, other hadrophilic colloids can also be used and they include, for example, gelatin derivatives, graft polymers of gelatin and other synthetic polymers, proteins such as albumin, casein, etc.; sulfric acid esters of cellulose, etc.; sugar derivatives such as sodium alginate, starch derivatives, etc.; polyvivylalcohol, partially acetated polyvinylalcohol, poly-N-pyrrolidone, polyacrylic acid, polymethacrylic acid, polyacrylamide, polyvinylimidazole, polyvinylpyrazole, etc. cellulose derivatives such as hydroxyethylcellulose, carboxymethylcellulose, cellulose sulfate, etc.; sugar derivatives such as sodium alginate and starch derivatives; stnthetic hydrophilic polymeric materials such as polyvinyl alcohol, a partial actal thereof, poly-N-vinyl pyrrolidone, polyacrylic acid, polymetaacrylic acid, polyacrylamide, polyvinyl imidazole, polyvinyl pyrazole and a copolymer thereof.

Gelatins such as lime-treated gelatin and acid-treated gelatin, and hydrolyzed or enzymatic process gelatin thereof can be used in the present invention.

A silver halide of the present invention may contain a dispersion of water-insoluble or sparingly water-sluble polymer for the purpose of improving dimentional stability, i.e., an alkyl (meta)acrylate, an alkoxyacryl(meta)acrylate, a glycidyl (meta)acrylate, (meta)acrylamide, vinyl eater (e.g., vinyl acetate), an acrylonirile, an olefin, stylene, and a combination thereof or a copolymer thereof with acrylic acid, metaacrylic acid, α,β-unsaturated dicarboxylic acid, hydroxyalkyl (meta)acrylate, sulfoalkyl (meta)acrylate and stylene sulfonate.

A silver halide emulsion of the invention may contains various sensitizing dye(s), besides the inventive dye. A preferred sensitizing dye is referred to Research Disclosures Vol.176, 17643 pp23–24 (1978), and Vol.346, 34685 (1993).

A photographic light-sensitive material used in the present invention may contain other various kinds of additives such as a desensitizer, a plasticizer, a sliding agent, a development-accelerating agent, an oil and a dye.

These additives including afore-mentioned ones are referred to Research Disclosure Vol.176 (afore-cited) pp 22–31.

A light sensitve material of the invention comprises single or multi-layered emulsion layer and protective layer. In the case of multi-layers, an interlayer may be provided therebetween.

In the light sensitive material of the invention, a photographic emulsion layer and another layer may be provided on one side or both sides of a flexible support conventionally used. an usable flexible support is a synthetic polymer film comprising cellulose acetate, cellulose actate propyonate, polystylene or polyethylen terephthalate.

Developing agents which can be used in present invention include dihydroxy benzenes, for example, hydroquinone, chlorohydroquinone, bromohydroquinone, 2,3-dichlorochlorohydroquinone, methylhydroquinone, iso-propyl hydroquinone, 2,5-dimethylhydroquinone etc.; 3-pyrazolidone compounds such as 1-phenyl-3-pyrazolidone, 1-phenyl-4-methyl-3-pyrazolidone, 1-phenyl-4,4-dimethyl-3-pyrazolidone; 1-phenyl- 4-ethyl-3-pyrazolidone, 1-phenyl-5-methyl-3-pyrazolidone, etc.; aminophenol compounds, such as o-aminophenol, p-aminophenol, N-methyl-o-aminophenol, N-methyl-p-aminophenol, 2,4-diaminophenol, etc.; pyrogallol, ascorbinic acid, 1-aryl-3-pyrazoline compounds, such as, 1-(p-hydroxyphenyl)- 3-aminopyrazoline, 1-(p-methylaminophenyl-3-aminopyrazoline, 1-(p-amino phenyl)-3-aminopyrazoline, 1-(p-amino-N-methylphenyl)- 3-pyrazolidone, etc. which can be used either singly or in combination. A combined used of a 3-pyrozolidone and a dihydroxybenzene, or an aminophenol and a dihydroxybenzene is preferable.

It is preferable that the developing agent is usually used in an amount of 0.01 to 1.4 mols/liter.

In the present invention, as anti silver-sludging agent, compounds disclosed in Japanese Patent Publication No. 62-4702/1987, Japanese Patent O.P.I. Publications Nos. 3-51844/1991, 4-26838/1992, 4-362942/1992 and 1-319031/1989 can be mentioned.

Especially, a compound represented by the following formula [P] is preferable.

Formula [P]

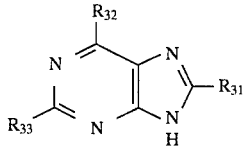

In the formula, $R_{31}$ and $R_{32}$ independently represent a hydrogen atom, a halogen atom, an alkyl group, an alkoxy group, an aryl group, an aralkyl group, a hydroxyl group, a mercapto group, a carboxyl group, a sulfo group, a phosphono group, an amino group, a nitro group, a cyano group, an alkoxycarbonyl group, an aryloxycarbonyl group, a carbamoyl group, and a sulfamoyl group, provided that $R_{31}$ and $R_{32}$ may be bonded with each other to form a ring. $R_{33}$ represents a hydrogen atom, a mercapto group or a hydroxyl group. Representative examples of the compound represented by formula [P] are given below:

P-1

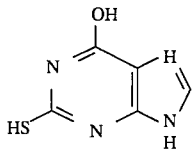

-continued

P-2

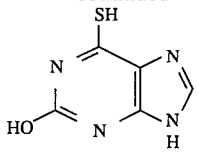

P-3

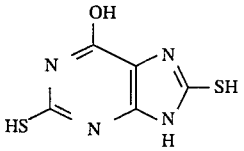

P-4

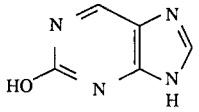

P-5

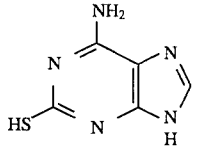

P-6

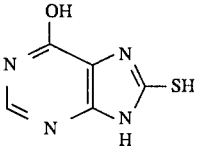

P-7

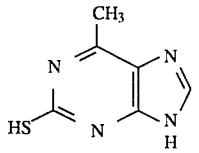

P-8

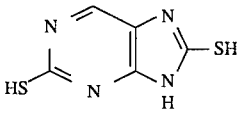

It is preferable that the anti-sludging agent be added to the developing solution. However, it can also be incorporated into the light-sensitive material.

In the present invention, as preservatives, a sulfite, metabisulfite such as sodium sulfite, potassium sulfite, ammonium sulfate and ammonium metabisulfite, etc. can be used. It is preferable that these sulfites are used in an amount of not less than 0.25 mol/liter and, more preferably, not less than 0.4 mol/liter.

In the developing solution, if necessary, there can be added other photographic additive, for example, Alkali agent such as sodium hydroxide, potassium hydroxide, etc.; pH buffer such as carbonate, phosphate, borate, acetate, alkanol amine, etc.; dissolution aid, for example, polyethylene glycol, esters thereof, alkanol amine, etc; sensitizer, for example, nonionic surface active agent which contains polyoxy ethylene, quaternary ammonium compound, etc.; surfactant, anti-foaming agent; antifoggant, for example, halides such as potassium bromide and sodium bromide, nitrobenzindazole, benztriazole, benz-thiazole, tetrazoles, thiazoles, etc; chelating agent, such as ethylenediaminetetraacetic acid or alkali metal salt thereof, nitrilotriacetate, poly phosphate, etc.; development accelerator, for example, compounds disclosed in U.S. Pat. No. 2,304,025, Japanese Patent Publication No. 47-45541/1972, etc.; gelatin hardeners such as glutal aldehyde or bisulfite addition product thereof, etc. It is preferable that pH of the developing solution is adjusted to between 9.5 and 10.5.

As a special manner of photographic developing process, a light-sensitive material which contains a developing agent in the emulsion layer can be processed in an activator processing solution such as an aqueous alkaline solution. This photographic processing, which is further combined with the stabilization processing by use of a thiocyante is often used as one of methods of processing rapidly the light-sensitive material. When the present invention is applied to such rapid processing, the effect thereof is especially large.

A fixer containing a conventional composition can be used. The fixer is aqueous solution which consists of a fixing agent and others, in general. pH thereof is usually 3.8–5.8. As fixing agent, there can be used sodium thiosulfates such as sodium thiosulfate, potassium thiosulfate and ammonium thiosulfates, thio cyanates such as sodium thiocyanate, potassium thiocyanate and ammonium thiocyanate, and an organic sulfur compound capable of forming soluble stable silver complex salt, which is known as a fixing agent.

A water soluble aluminium salt such as aluminium chloride, aluminium sulfate or potassium alum, which is capable of acting as a hardener can be added to the fixing solution.

The fixing solution may contain a preservative (e.g., a sulfite or a bisulfite), a pH buffer (e.g., acetic acid), a pH adjuster (e.g., sulfuric acid) and a chelating agent capable od softening hard water.

A developer may be a mixture of fixed compositions, an organic aqueous solution containing a glycol or amine, or a viscous solution in the form of half degumming. Each of these can be used on dilution or as it is.

When processed in the present invention, a developing temperature can be set to be a conventional range of 20° to 30° C. When processed at a high temperature, it can be set to a range of 30° to 40° C.

In the present invention, a black and white photographic material is preferably processed by use of an automatic processor. The photographic material is processed by replenishing a developer at a given rate in proportion to the area of the photographic material. The replenishing rate is 300 ml or less, preferably, 75 to 200 ml per $m^2$ of the material so as to reduce the amount of waste liquor.

When processed with a automatic processor in the present invention, a total processing time which is the time from the insertion of a leading end of the film to the processor to a point of going-out from a drying zone is preferably 20 to 60 seconds from demand for shortening a processing time. The total processing time refers a time taken in the overall process necessary for processing the black and white photographic material, i.e., a time taken for a total process including, for example, developing, fixing, bleach, washing, stabilizing and drying and so-called, Dry to Dry time. In the case when a total processing time is 20 seconds or less, satisfactory photographic performance cannot be achieved due to desensitizing or contrast-decreasing thereof. The total processing time (Dry to Dry time) is preferably 30 to 60 seconds.

EXAMPLES

The present invention is further illustrated by the example.

Example 1

(Preparation of silver halide emulsion)

Silver iodobromochloride (Silver chloride 62 mol %, silver iodide 0.5 mol %) emulsion was prepared by the use of double-jet precipitation process.

$8\times10^{-8}$ mol/mol Ag of potassium hexabromorhodate and $8\times10^{-7}$ mol/mol Ag of potassium hexachloroiridate were added during the mixing process after 5% of the final average grain size to be attained had been formed and up to the final average grain size.

Silver halide emulsion thus obtained was desalted by conventional floccuration process using the a gelatin which was modified by phenylisocyanate, and then dispersed in an aqueous gelatin solution, to which Compounds (A), (B) and (C) were added as anti-molds, to obtain a mono disperse silver halide emulsion containing cubic silver halide grains having an average grain size of 0.30 μm and a coefficient of variation of 10%.

[A]:[B]:[C] = 46:50:4 (molar ratio)

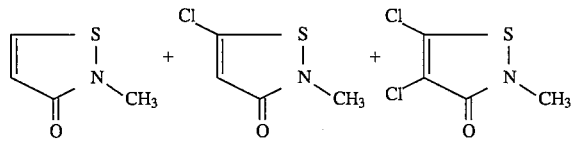

[A] + [B] + [C]

After adding citric acid and potassium bromide to the emulsion, chloroaurate and sodium thiosulfate were further added to carry out chemical ripening at 60° C., and after reaching the maximum sensitivity, 50 mg of 1-phenyl-5-mercaptotetrazole and 1 g of a mol of silver were added thereto to stop the chemical ripening.

(Preparation of coating solution)

$2\times10^{-4}$ mols per a mol of silver halide of the exemplified compound of the present invention and those for comparison as shown in Table 1 were added to the emulsion thus obtained. Then, after adding adequate amount of sodium dodecyl benzene sulfonate as a surfactant and sodium 2,4-dichloro-6-hydroxytriazine as a hardener to the emulsion, the emulsion was coated uniformly on a subbed polyethylene terephthalate film so that the coated amount of silver and gelatin per 1 $m^2$ of the film were 4 g and 3g, respectively.

The coated samples were exposed through an optical wedge to He—Ne laser light for a period of $10^{-6}$ seconds processed with a developer and a fixer as described below by using a automatic processor, provided that as a developer was used a fresh solution or a running solution in which 20 $m^2$ of 50% exposed film was processed. The sample was sensitometrically measured by using an optical densitometer Konica PDA-65, a product of Konica Corporation. Sensitivity in the table was defined as the reciprocal of the exposure amount necessary for obtaining optical density of 3, which was represented by a relative value when the sensitivity of comparative sample No.1 was set to be 100. A fog density was represented as a density of non-light-exposed film (including a base density) which was previously held under irradiation from a UV-radiating fluorescent lamp to remove effects of dye-color. Moreover, the sample was evaluated as follows.

Residual color of the film

After an unexposed film was processed, the film was evaluated by visual observation in five piece piling.

The samples were classified into five grades. The level at which the residual color was hardly visible was made "5", the level at which practical use was possible was made "3" and the level at which practical use was impossible was made "1".

Degree of residual Color in the developing solution

The developer after running was taken in a 200 ml flask to determine the level of coloring by the residual dye in the solution.

A level at which coloring of the developing solution by the sensitizing dye was assumed to be "G" (good) and the level at which coloring is clearly observable was "F" (Fair) and the level at which the coloring is remarkable was assumed to be "P" (Poor).

<Processing Conditions>

The processing conditions are as follows:

| Composition of the developing solution | |
|---|---|
| (Composition A) | |
| Water (deionized water) | 150 ml |
| Disodium ethylenediaminetetraacetate | 2 g |
| Diethylene glycol | 50 g |
| Potassium sulfite (55% W/V aqueous solution) | 100 ml |
| Potassium carbonate | 50 g |
| Hydroquinone | 15 g |
| 5-methylbenztriazole | 200 ml |
| 1-phenyl-5-mercaptotetrazole | 30 mg |
| Potassium hydroxide | Amount necessary to adjust pH of the solution at 10.4. |
| Potassium bromide | 4.5 g |
| (Composition B) | |
| Water (deionized water) | 3 ml |
| Diethylene glycol | 50 g |
| Disodium ethylenediaminetetraacetate | 25 mg |
| Acetic acid (90% aqueous solution) | 0.3 ml |
| 5-Nitroindazole | 110 mg |
| 1-phenyl-3-pyrazolidone | 500 mg |

Compositions A and B were respectively dissolved in 500 ml of water 500 ml in this order and finished at one liter when the developer is used.

| Compositions of fixing solution | |
|---|---|
| (Composition A) | |
| Ammonium thiosulfate (72.5% W/V aqueous solution) | 230 ml |
| Sodium sulfite | 9.5 g |
| Sodium acetate trihydrate | 15.9 g |
| Boric acid | 6.7 g |
| Sodium citrate dihydrate | 2 g |
| Acetic acid (90% W/W aqueous solution) | 8.1 ml |
| (Composition B) | |
| Water (deionized water) | 17 ml |
| Sulfuric acid (50% W/W aqueous solution) | 5.8 g |
| Aluminium sulfate (8.1% W/W aqueous solution) | 26.5 g |

Compositions A and B were respectively dissolved in 500 ml of water in this order and finished at one liter when the solution was used. pH of this fixer was approximately 4 and the replenishing amount was 400 ml/m$^2$.

| | Processing condition: | | |
|---|---|---|---|
| Step | Temperature | Time | Tank capacity |
| Development | 34° C. | 15 sec | 3 liter |
| Fixing | 34° C. | 15 sec | 2 liter |
| Washing | Normal | 10 sec | 2 liter |
| Drying | 40° C. | 10 sec | |

Time of each process contains so-called cross-over time to the next step.

The results are shown in Table 1.

TABLE 1

| | | Fresh solution processing | | | Developer | Running solution processing | | | Developer | |
|---|---|---|---|---|---|---|---|---|---|---|
| Sample No. | Dye | Sensitivity | Residual color | Fog | replenishing rate | Sensitivity | Residual color | Fog | residual color | Remarks |
| 1 | Comp. | 100 | 4 | 0.04 | 400 (ml/m$^2$) | 98 | 3 | 0.07 | F | Comp. |
| 2 | Comp. | 100 | 4 | 0.04 | 300 | 97 | 2 | 0.06 | P | Comp. |
| 3 | Comp. | 100 | 4 | 0.04 | 200 | 70 | 2 | 0.04 | P | Comp. |
| 4 | S-2 | 95 | 4 | 0.04 | 400 | 95 | 4 | 0.06 | G | Comp. |
| 5 | s-2 | 95 | 4 | 0.04 | 300 | 95 | 4 | 0.05 | G | Inv. |
| 6 | S-2 | 95 | 4 | 0.04 | 200 | 94 | 4 | 0.04 | F | Inv. |
| 7 | S-5 | 105 | 5 | 0.04 | 400 | 105 | 5 | 0.05 | G | Comp. |
| 8 | S-5 | 105 | 5 | 0.04 | 300 | 105 | 4 | 0.04 | G | Inv. |
| 9 | S-5 | 105 | 5 | 0.04 | 200 | 103 | 4 | 0.04 | G | Comp. |
| 10 | S-14 | 130 | 5 | 0.04 | 400 | 130 | 5 | 0.05 | G | Inv. |
| 11 | S-14 | 130 | 5 | 0.04 | 300 | 128 | 5 | 0.04 | G | Inv. |
| 12 | S-14 | 130 | 5 | 0.04 | 200 | 125 | 4 | 0.04 | G | Inv. |

Comparative sensitizing dye (Comp.)

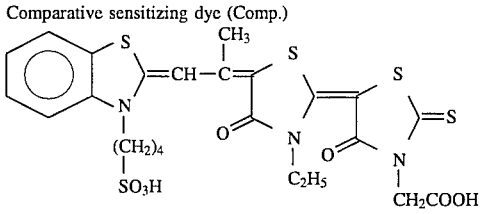

It is shown from Table 1 that the samples prepared according to the present invention exhibit improved in residual color of a film and coloring in the developing solution at a small amount of replenishing and that this property remains after continuous running process.

Example 2

Preparation for silver halide photographic emulsion

Silver chlorobromide emulsion, of which silver chloride content was 70% and silver bromide content was 30%, was prepared by the use of simultaneous controlled double-jet precipitation process. pAg and pHg of the mixed solution was adjusted at 7.8 and 3.0, respectively, and $2\times10^{-7}$ mols/mol of silver of potassium hexabromorhodate was added during grain formation.

Silver halide emulsion thus obtained was desalted by conventional floccuration process using the a gelatin which was modified by phenylisocyanate, and then re-dispersed in an aqueous gelatin solution, to which the same anti-molds as Example 1 were added to obtain a monodisperse silver halide emulsion containing cubic silver halide grains having an average grain size of 0.25 μm and a coefficient of variation of 10%, respectively.

After adding 3 mg of chloroaurate and 0.5 g of elemental sulfur per mol of silver to the emulsion, the emulsion was subjected to chemical ripening at 60° C. for 40 minutes, and at the time of completion of chemical ripening, 500 mg of 1-phenyl- 5-mercaptotetrazole and 900 mg of 4-methyl-6-hydroxy-1,3,3a,7-tetrazaindene per one mol of silver were added.

Preparation of silver halide light-sensitive photographic material

On one side of a 100 μm-thick polyethyleneterephthalate support, both surfaces of which are provided with a 0.1 μm-thick subbing layer formed with reference to the disclosure in Japanese Patent O.P.I. Publication No. 59-19941/1983, a silver halide light-sensitive emulsion layer was coated so that the coated amount of silver and gelatin per 1 $m^2$ of the film were 3.2 g and 2.6 g, respectively. Then on the emulsion layer, a protective layer, and on another side, a backing layer and a protective layer for the backing protective layer were coated to obtain a sample.

Composition for silver halide light-sensitive emulsion layer

| | |
|---|---|
| Gelatin | 1.8 $g/m^2$ |
| Silver halide emulsion A | 3.5 $g/m^2$ |
| Sensitizing dyes as shown in Table 2 | $2\times10^{-5}$ $mol/m^2$ |
| Antifoggant: | |
| 5-nitroi indazole | 10 $mg/m^2$ |
| 2-mercaptohypoxanthine | 2 $mg/m^2$ |
| Surfactant: | |
| Saponin | 0.1 $g/m^2$ |
| Sodium sulfosuccinate iso pentyl-n-decyl ester | 8.0 $g/m^2$ |
| Compound K | 30 $mg/m^2$ |
| Hydrazine derivative (shown in Table 2) | $3\times10^{-5}$ $mol/m^2$ |
| Nucleation accelerator (shown in Table 2) | $1.6\times10^{-4}$ $mol/m^2$ |
| Polymer latex P | 0.5 $g/m^2$ |
| Hardener H-1 | 60 $mg/m^2$ |
| Compound K | |

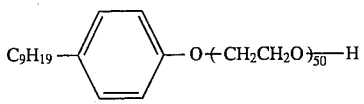

-continued

Polymer latex

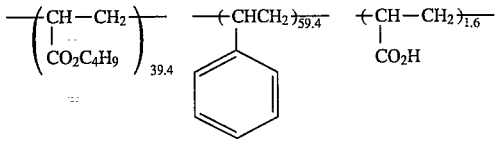

Hardener H-1

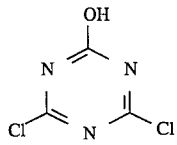

(Composition of protective layer)

| | |
|---|---|
| Gelatin | 1.5 $g/m^2$ |
| Surfactant: S-3 | |
| Sodium sulfosuccinic acid di(2-ethylhexyl)ester | 10 $g/m^2$ |
| $NaO_3S-CH(CH_2COOCH_2(CF_2)_6H)COOCH_2(CF_2)_6H$ | 2 $mg/m^2$ |
| Matting agent: Silica, 3.5 μm | 20 $mg/m^2$ |
| Hardener: Formalin | 30 $mg/m^2$ |

Composition of Backing Layer (a) 80 $mg/m^2$

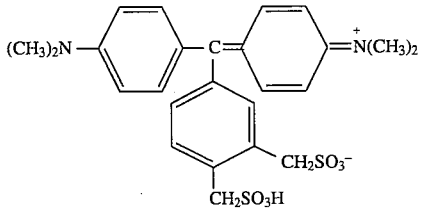

(b) 30 $mg/m^2$

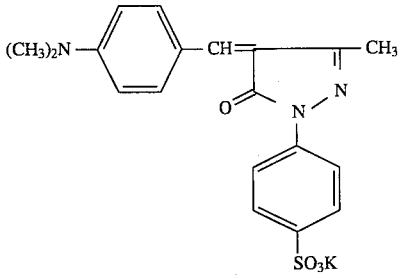

(c) 30 $mg/m^2$

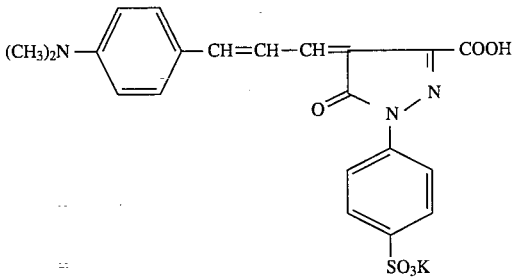

-continued

| | |
|---|---|
| Gelatin | 2.4 g/m$^2$ |
| Surfactant: Sodium dodecyl benzene sulfonate | 50 mg/m$^2$ |

Composition of the protective layer for the backing layer .

| | |
|---|---|
| Gelatin | 1 g/m$^2$ |
| Matting agent: Polymethylmethacrylate having average grain size of 5.0 microns | 50 mg/m$^2$ |
| Surfactant: Sodium sulfosuccinic acid Di(2-ethylhexyl) ester | 10 mg/m$^2$ |
| Hardener: Glyoxal | 25 mg/m$^2$ |
| Hardener: 2-hydroxy-4,6-dichlorotriazine | 35 g/m$^2$ |

The samples were exposeed to light, processed using processing solutions as below and running solutions thereof as Example 1 and evaluated with respect to sensitivity and residual color in the same manner as Example 1. The developing solution was replenished as shown in Table 2. The number of black spots produced in a 2 mm-square of unexposed portion was counted by magnifying them with a 50 times loupe.

(Photographic processing condition)

| Step | Temperature | Time |
|---|---|---|
| Development | 35° C. | 30 |
| Fixing | 33° C. | 20 |
| Washing | normal temperature | 20 |
| Drying | 40° C. | 40 |

Developer:

| | |
|---|---|
| Sodium sulfite | 55 g |
| Potassium carbonate | 40 g |

-continued (Photographic processing condition)

| | |
|---|---|
| Hydro quinone | 24 g |
| 1-Phenyl-4-dimethyl-3-pyrazolidone (dimezone) | 0.9 g |
| Potassium bromide | 5 g |
| 5-Methylbenzotriazole | 0.13 g |
| 1-Phenyl-5-mercaptotetrazole | 0.02 g |
| Boric acid | 2.2 g |
| 2-Mercaptohypoxanthine | 100 mg |
| Diethylene glycol | 40 g |

Water was added to make 1 liter and pH was adjusted with the sodium hydroxide, as shown in Table 2.

Fixer:

(Composition A)

| | |
|---|---|
| Ammonium thiosulfate (72.5 W/V % aqueous solution) | 240 cc |
| Sodium sulfite | 17 g |
| Sodium acetate trihydrate | 6.5 g |
| Boric acid | 6.0 g |
| Sodium citrate dihydrate | 2.0 g |

(Composition B)

| | |
|---|---|
| Water (deionized water) | 17 cc |
| Boric acid (50 W/V % aqueous solution) | 4.7 g |
| Aluminum borate (aqueous solution of $Al_2O_3$ conversion content 8.1 W/V %) | 26.5 g |

Composition A and composition B was dissolved in the water 500 cc, when using, in this order and made up to one liter. pH was adjusted by the acetic acid to 4.8.

The result is shown in Table 2.

TABLE 2

| | | | | Fresh solution processing | | | | Running solution processing | | | Replen-ing | |
|---|---|---|---|---|---|---|---|---|---|---|---|---|
| Sample No. | Dye | Hydra-zine | Nucleation accelerator | pH | Sensi-tivity | black spot | Residual color | Sensi-tivity | black spot | Residual color | amount (ml/m$^2$) | Remarks |
| 1 | Comp. 1 | H-13 | — | 11.5 | 100 | 10 | 4 | 80 | 12 | 4 | 250 | Comp. |
| 2 | Comp. 1 | H-13 | — | 11.0 | 80 | 2 | 3 | 70 | 5 | 3 | 250 | Comp. |
| 3 | Comp. 1 | H-13 | — | 10.5 | 60 | 1 | 3 | 55 | 2 | 2 | 250 | Comp. |
| 4 | S-14 | H-13 | — | 11.5 | 120 | 12 | 4 | 100 | 14 | 4 | 250 | Comp. |
| 5 | S-14 | H-13 | — | 11.0 | 90 | 3 | 4 | 85 | 5 | 3 | 250 | Comp. |
| 6 | S-14 | H-13 | — | 10.5 | 80 | 1 | 4 | 75 | 1 | 3 | 250 | Inv. |
| 7 | S-14 | H-13 | Na-9 | 10.5 | 200 | 2 | 4 | 190 | 2 | 3 | 250 | Inv. |
| 8 | Comp. 1 | H-13 | Na-9 | 10.5 | 180 | 1 | 3 | 160 | 30 | 2 | 250 | Comp. |
| 9 | Comp. 2 | H-13 | Na-9 | 10.5 | 170 | 5 | 3 | 180 | *1 | *1 | 250 | Comp. |
| 10 | S-15 | H-13 | Na-9 | 10.5 | 170 | 2 | 5 | 160 | 3 | 4 | 250 | Inv. |
| 11 | S-19 | H-13 | Na-9 | 10.5 | 220 | 3 | 5 | 200 | 4 | 5 | 250 | Inv. |
| 12 | S-20 | H-13 | Na-9 | 10.5 | 180 | 2 | 5 | 160 | 2 | 5 | 250 | Inv. |
| 13 | S-20 | H-13 | Na-9 | 10.5 | 180 | 2 | 5 | 160 | 3 | 5 | 300 | Inv. |
| 14 | S-20 | H-13 | Na-9 | 10.5 | 180 | 2 | 5 | 165 | 6 | 5 | 400 | Inv. |
| 15 | S-15 | H-6 | Na-9 | 10.5 | 240 | 3 | 5 | 230 | 2 | 4 | 250 | Inv. |
| 16 | S-14 | H-6 | Nb-4 | 10.5 | 240 | 2 | 5 | 235 | 3 | 4 | 250 | Inv. |

*1 non-measurable

Comparative dye (Comp. 1)

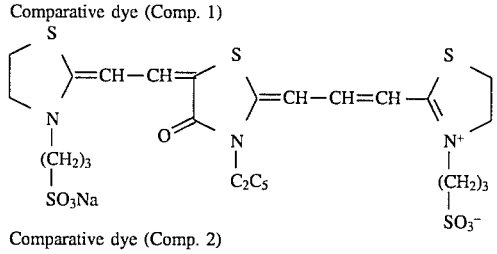

Comparative dye (Comp. 2)

TABLE 2-continued

| Sample No. | Dye | Hydrazine | Nucleation accelerator | Fresh solution processing pH | Sensitivity | black spot | Residual color | Running solution processing Sensitivity | black spot | Residual color | Replening amount (ml/m²) | Remarks |
|---|---|---|---|---|---|---|---|---|---|---|---|---|

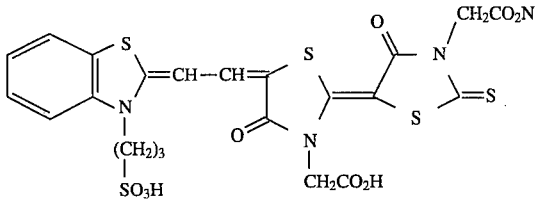

As can be seen from the results in Table 2, the inventive samples exhibited lowering in residual color and prevention of occurrence of black spot, and led excellent results even when running-processed.

What is claimed is:

1. A method of forming an image comprising imagewise-exposing a silver halide photographic light sensitive material and developing the exposed photographic material with a developer to form the image, wherein said silver halide photographic material contains a spectral sensitizing dye represented by the following formula (S), and a hydrazine compound represented by formula (Ha) and wherein said photographic material is developed with a developer having a pH of 10.9 or less, said developer being replenished by a developer-replenishing solution having a pH value of 10.9 or less in an amount of 300 ml or less per $m^2$ of the photographic material, formula (S)

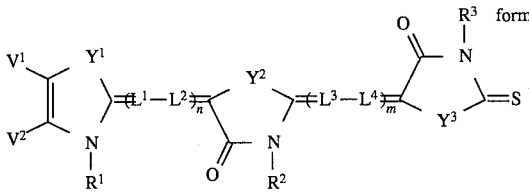

wherein $Y^1$, $Y^2$ and $Y^3$ independently represent —N(R)— group, an oxygen atom, a sulfur atom or a selenium atom provided that at least one of $Y^1$, $Y^2$ and $Y^3$ is not selected to be either a sulfur or selenium atom; R, $R^1$, $R^2$ and $R^3$ independently represent an aliphatic group, an aryl group or a heterocyclic group, provided that at least one of R, $R^1$, $R^2$ and $R^3$ has a water-solubilizing group as a substituent; $V^1$ and $V^2$ independently represent a hydrogen atom, an alkyl group, an alkoxy group or an aryl group, and $V^1$ and $V^2$ may combine with each other to form a ring; $L^1$, $L^2$, $L^3$ and $L^4$ independently represent a methine group n is 1 or 2; m is 0 or 1 formula (Ha)

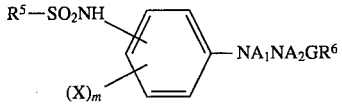

wherein $R^5$ represents an aliphatic group, an aryl group or a heterocyclic group; $R^6$ represents a hydrogen atom, an aliphatic group, an aryl group, a heterocyclic group, an amino group, an alkoxy group, an aryloxy group, —$COOR_8$, or —$CON(R_9)(R_{10})$, in which $R_8$ represents a hydrogen atom, an alkyl group, an alkenyl group, an alkynyl group, an aryl group or a heterocyclic group; and $R_9$ and $R_{10}$ represents each a hydrogen atom, an alkyl group, an alkenyl group, an alkynyl group, an aryl group, a heterocyclic group, hydroxy, an alkoxy group, an alkenyloxy group, an alkynyloxy group, an aryloxy group, a heterocyclicoxy group or an amino group; $A_1$ and $A_2$ are both hydrogen atoms, or one of them is a hydrogen atom and the other one is an acyl group, a sulfonyl group or an oxyalyl group; G represents a carbonyl group, a sulfonyl group, a sulfoxy group, a phosphoryl group or iminomethylene group; X represents a substituent; m is an integer of 0 to 4.

2. The method of claim 1, wherein said silver halide photographic material further contains a nucleation-accelerating compound represented by formula [Na] or formula [Nb], Formula [Na]

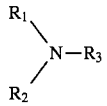

wherein $R_1$, $R_2$ and $R_3$ independently represent a hydrogen atom, an alkyl group, an alkenyl group, an alkynyl group or an aryl group, and $R_1$, $R_2$ and $R_3$ may combine with each other to form a ring, formula [Nb]

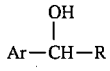

wherein Ar represents an aryl group or a heterocyclic group; R represents a hydrogen atom, an alkyl group, an alkenyl group, an alkynyl group or an aryl group; and Ar and R may combine through a linkage group to form a ring.

3. The method of claim 1, wherein said silver halide photographic material contains said hydrazine compound of formula (Ha) is selected from the group consisting of:

H-5
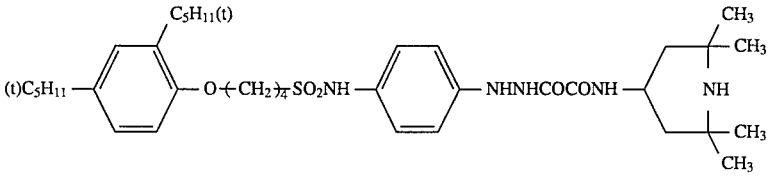
H-6
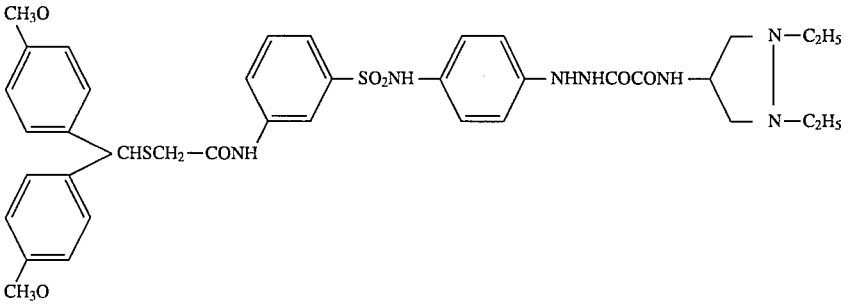
H-7
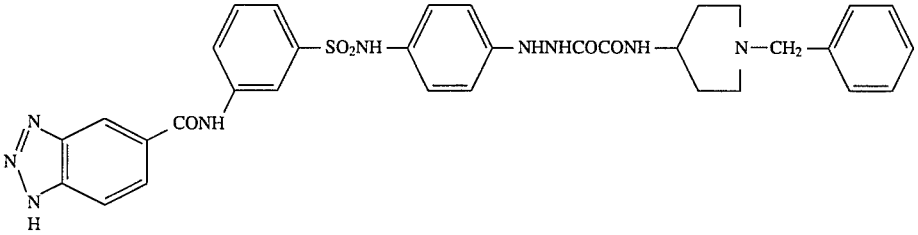
H-9
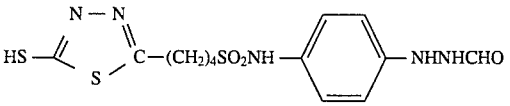
H-10
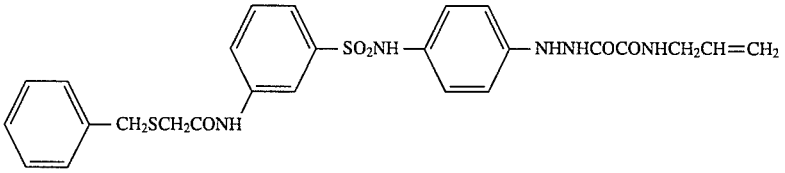
H-11
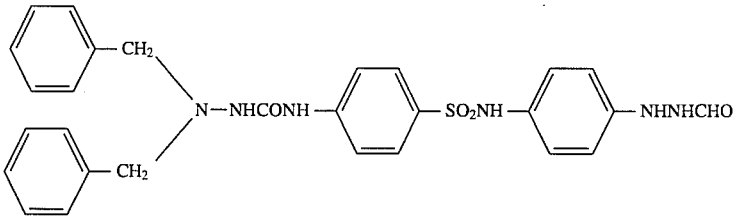
H-12
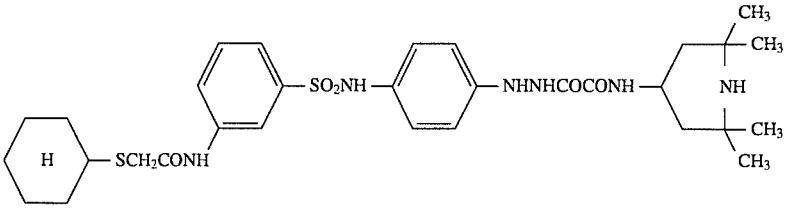

-continued
H-13
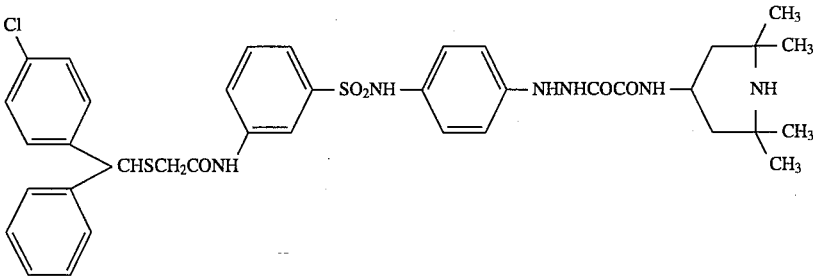
H-14
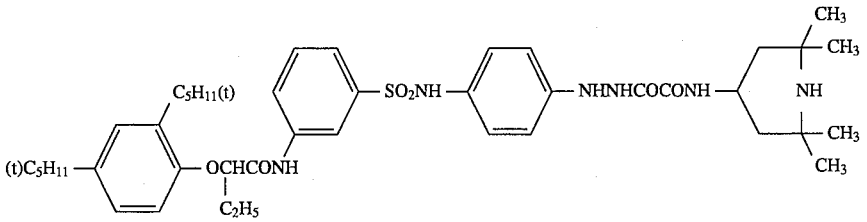
H-16
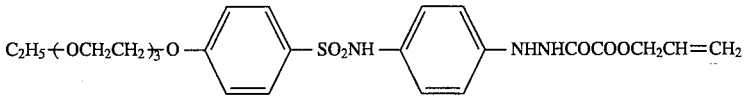
H-17
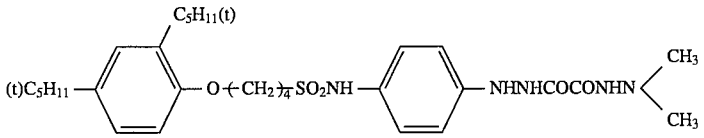
H-19
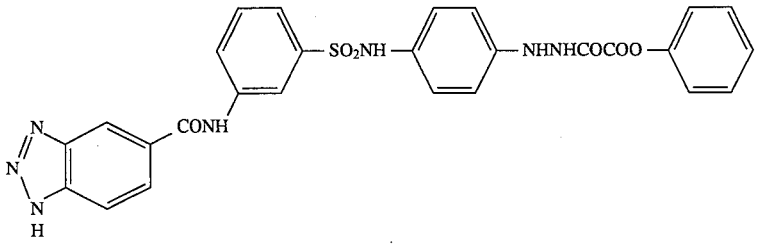
H-22
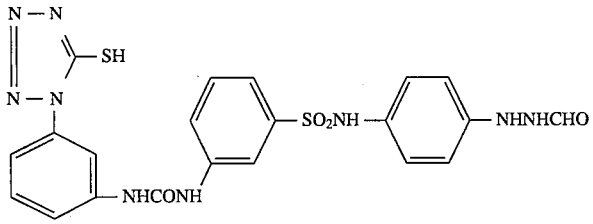
H-23
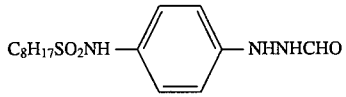
H-26
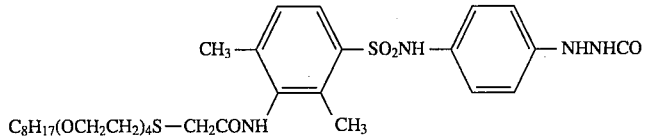
H-27
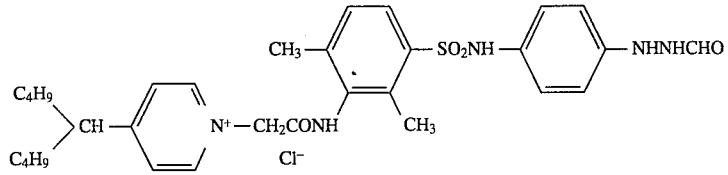

-continued
H-28
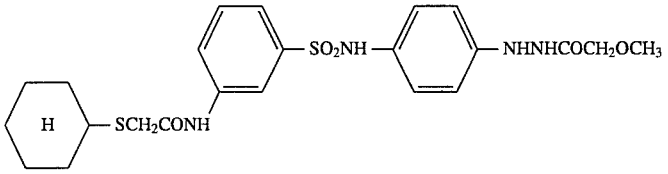
H-30
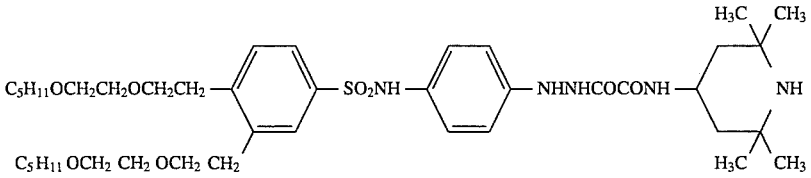
H-33
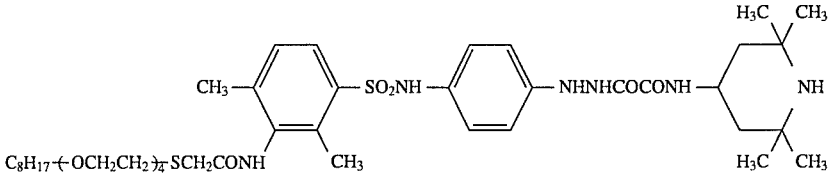
H-34
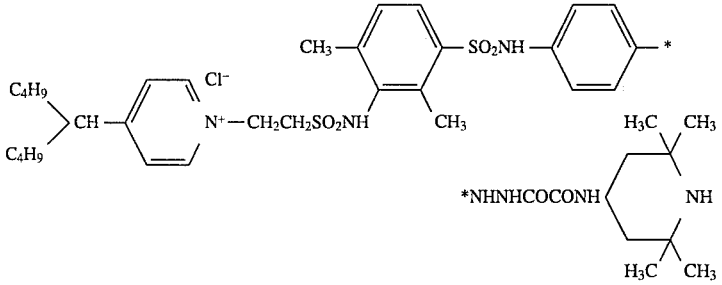
H-36
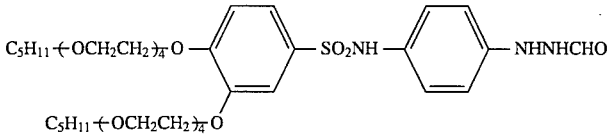
H-37
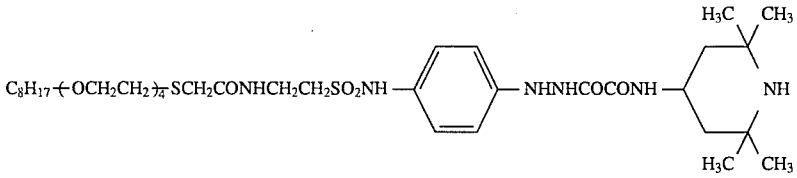
H-38
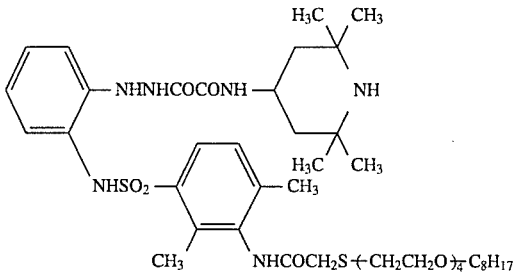
H-39
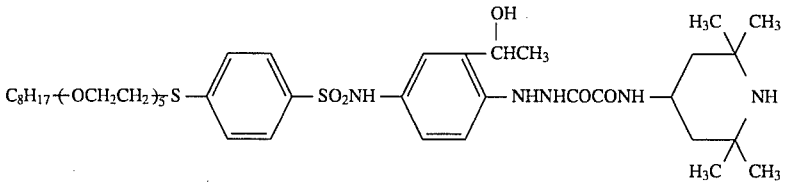

-continued
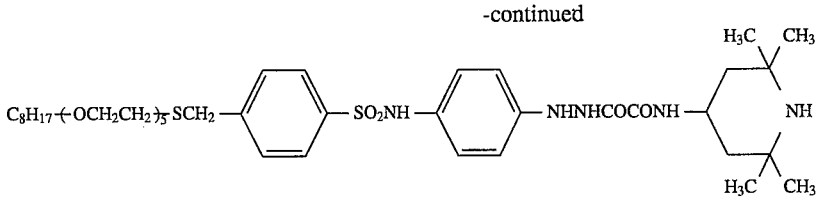
H-40
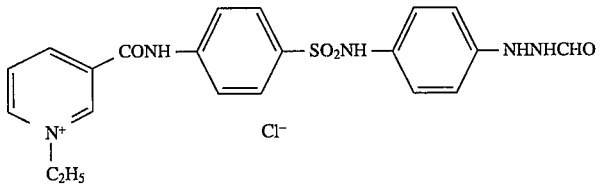
H-41
and
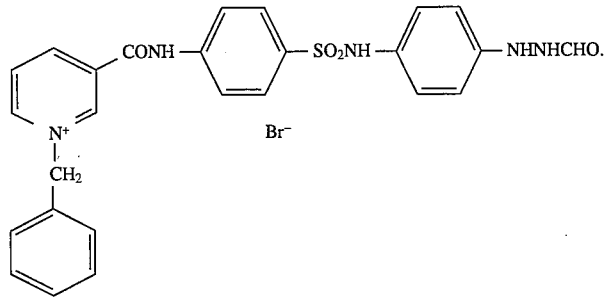
H-42
4. The method of claim 1, wherein said silver halide photographic material contains said hydrazine compound of formula (Ha) is selected from the group consisting of:
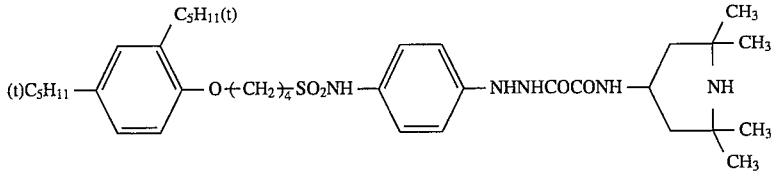
H-5
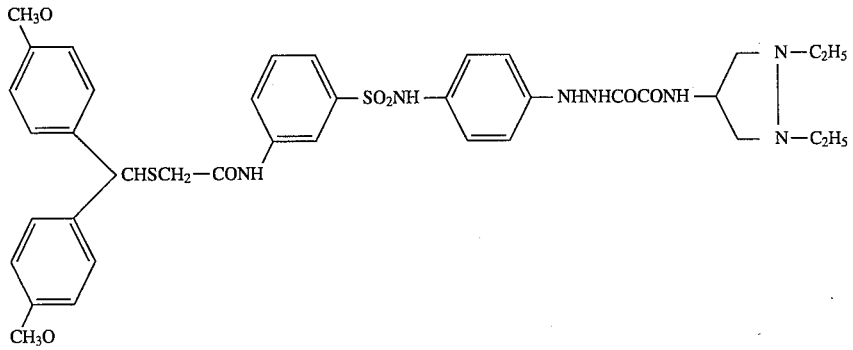
H-6
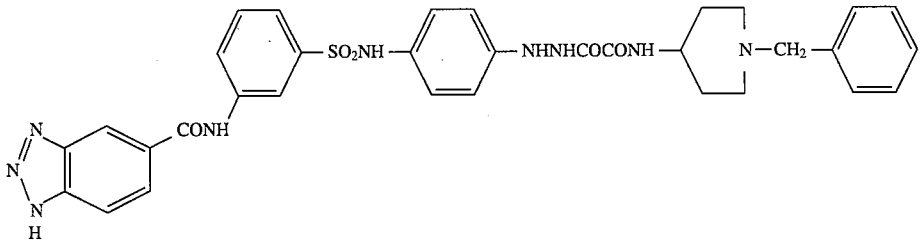
H-7

-continued
H-8
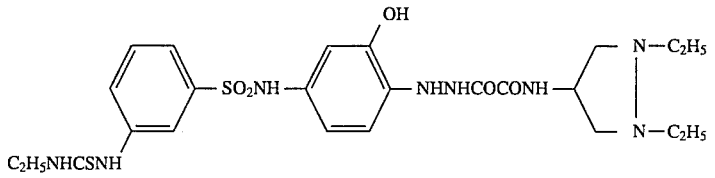
H-9
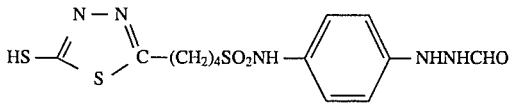
H-10
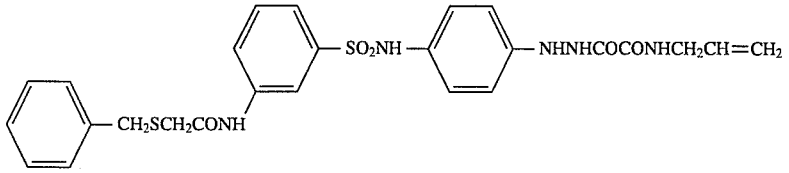
H-11
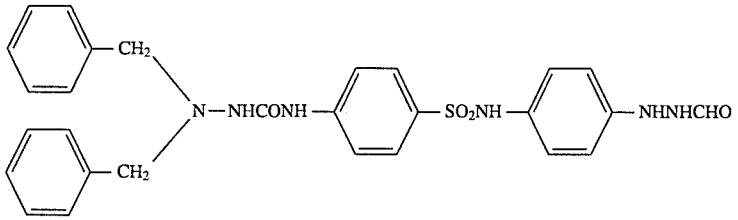
H-12
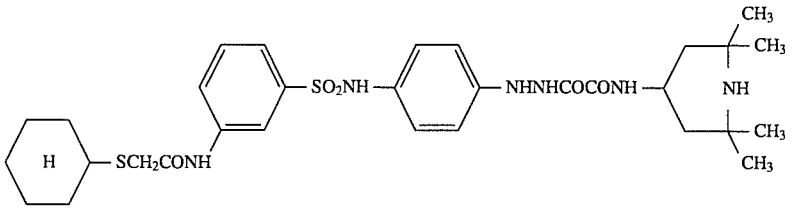
H-13
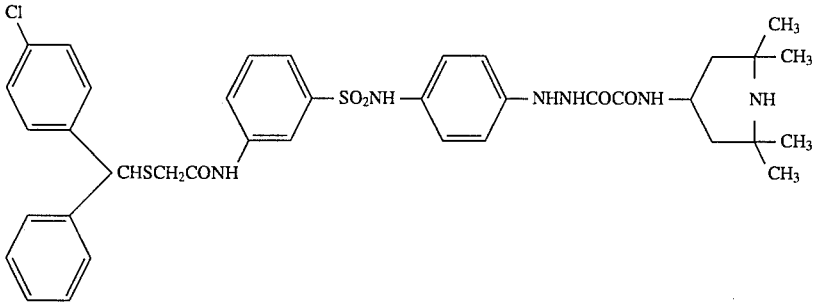
H-14
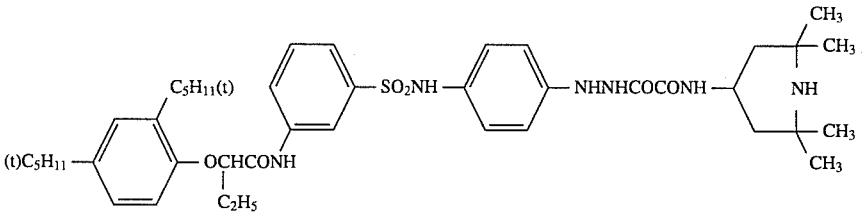
H-16
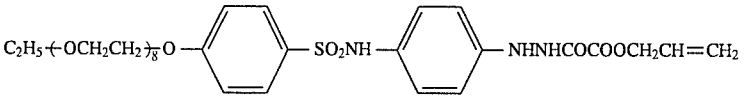

-continued
H-17
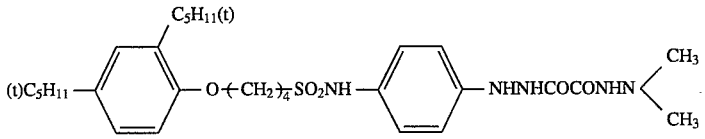
H-19
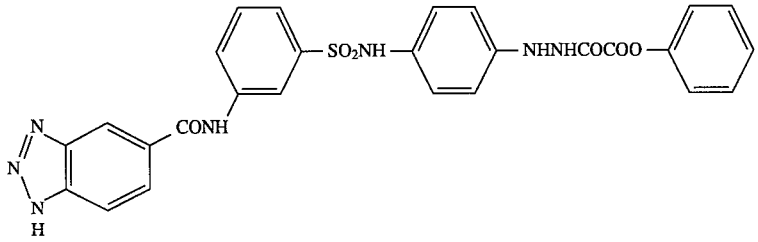
H-21
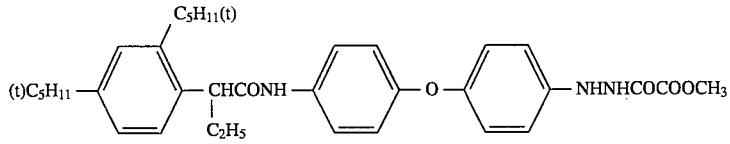
H-22
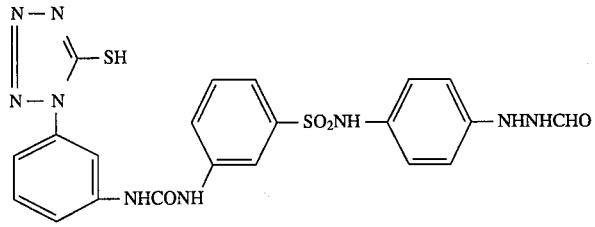
H-23
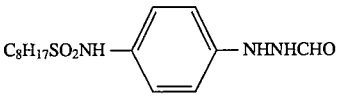
H-26
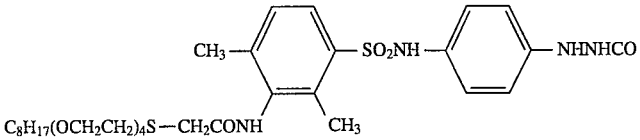
H-27
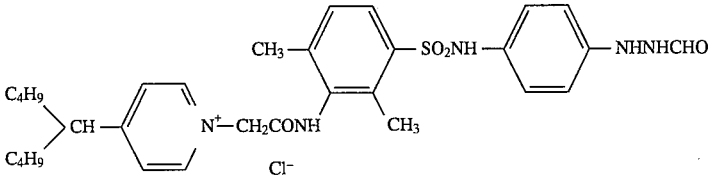
H-28
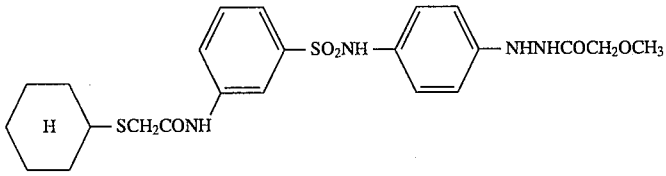
H-30
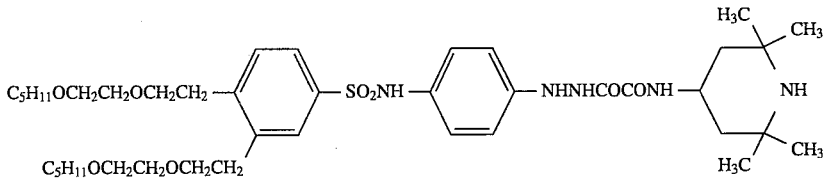

-continued
H-33
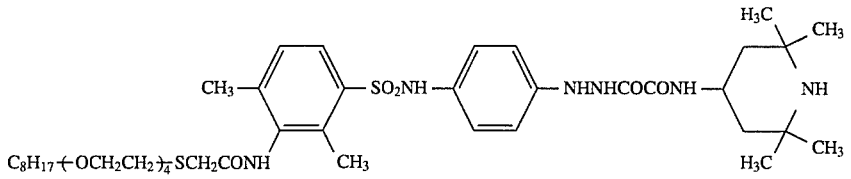
H-34
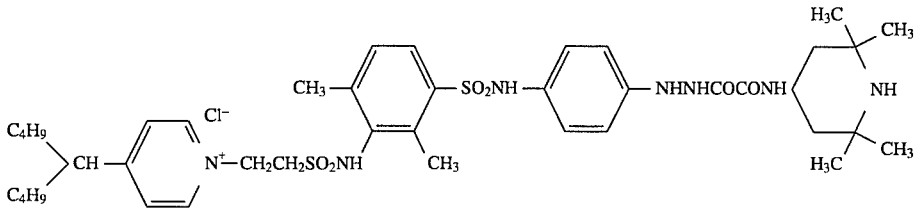
H-35
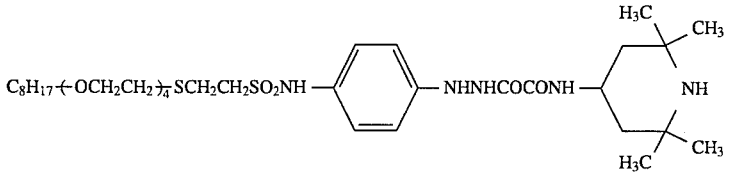
H-36
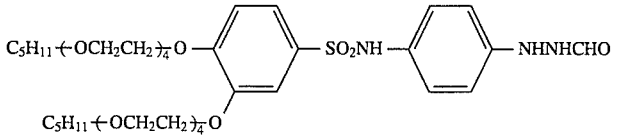
H-37
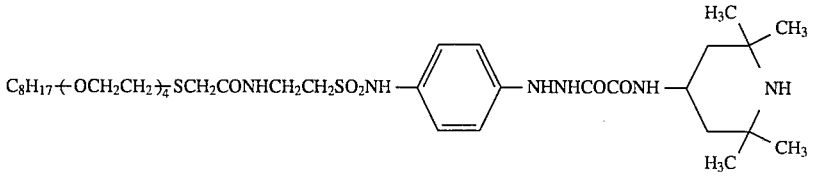
H-38
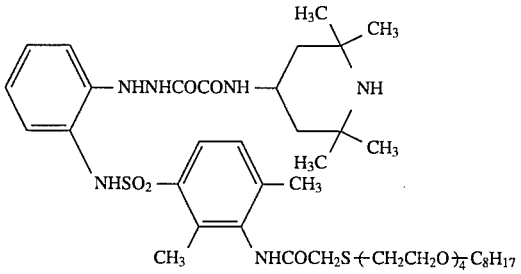
H-39
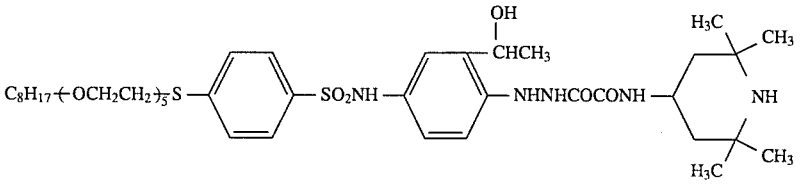
H-40
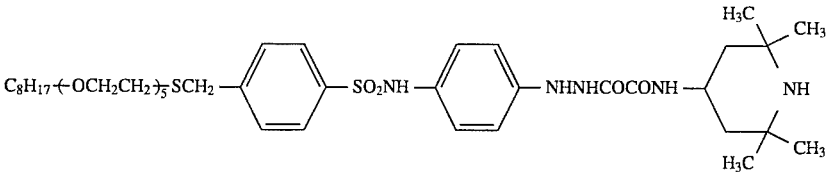

-continued
H-41
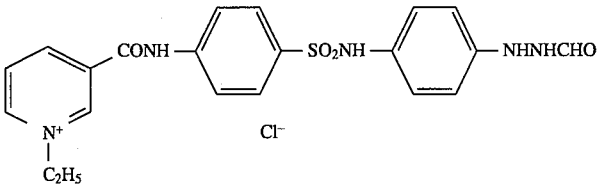
and
H-42
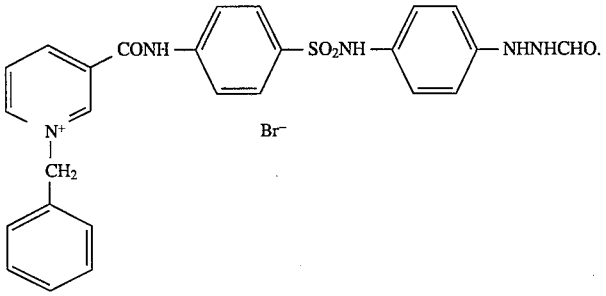
* * * * *